US009732285B2

(12) United States Patent
Krupa et al.

(10) Patent No.: US 9,732,285 B2
(45) **Date of Patent: *Aug. 15, 2017**

(54) PROCESS FOR OLIGOMERIZATION OF GASOLINE TO MAKE DIESEL

(71) Applicant: UOP LLC, Des Plaines, IL (US)

(72) Inventors: Steven L. Krupa, Fox River Grove, IL (US); Christopher P. Nicholas, Evanston, IL (US); Todd M. Kruse, Oak Park, IL (US); Kurt M. Vanden Bussche, Lake in the Hills, IL (US)

(73) Assignee: UOP LLC, Des Plaines, IL (US)

( * ) Notice: Subject to any disclaimer, the term of this patent is extended or adjusted under 35 U.S.C. 154(b) by 175 days.

This patent is subject to a terminal disclaimer.

(21) Appl. No.: 14/108,678

(22) Filed: Dec. 17, 2013

(65) Prior Publication Data

US 2015/0166428 A1 Jun. 18, 2015

(51) Int. Cl.
*C10G 50/00* (2006.01)

(52) U.S. Cl.
CPC ..... *C10G 50/00* (2013.01); *C10G 2300/1088* (2013.01); *C10G 2400/04* (2013.01); *C10G 2400/30* (2013.01)

(58) Field of Classification Search
CPC .. C07C 2/12; C07C 11/02; C07C 2/04; C07C 2529/50; C07C 2527/173; C10G 50/00; C10G 2400/02; C10G 2300/1086
See application file for complete search history.

(56) References Cited

U.S. PATENT DOCUMENTS

| | | | |
|---|---|---|---|
| 4,268,701 | A | 5/1981 | Dang Vu et al. |
| 4,433,185 | A | 2/1984 | Tabak |
| 4,456,781 | A | 6/1984 | Marsh et al. |
| 4,520,215 | A | 5/1985 | Owen et al. |
| 4,568,786 | A | 2/1986 | Hsia Chen et al. |
| 4,665,245 | A | 5/1987 | Quann |
| 4,822,477 | A | 4/1989 | Avidan et al. |
| 4,926,003 | A | 5/1990 | Harandi et al. |
| 4,956,514 | A | 9/1990 | Chu |
| 5,000,840 | A | 3/1991 | Anthes et al. |
| 5,051,386 | A | 9/1991 | Ward et al. |
| 5,073,351 | A | 12/1991 | Beech, Jr. et al. |
| 5,108,970 | A | 4/1992 | Young et al. |
| 5,243,112 | A | 9/1993 | Chester et al. |
| 5,264,643 | A | 11/1993 | DiGuiseppi et al. |
| 5,498,811 | A | 3/1996 | Perego et al. |
| 5,714,661 | A | 2/1998 | Tuli et al. |
| 5,811,608 | A | 9/1998 | Stine et al. |
| 6,444,866 | B1 | 9/2002 | Commereuc et al. |
| 6,686,511 | B2 | 2/2004 | Miller et al. |
| 6,875,899 | B2 | 4/2005 | Martens et al. |
| 7,008,527 | B2 | 3/2006 | Gauthier et al. |
| 7,196,238 | B2 | 3/2007 | Nurminen et al. |
| 7,262,332 | B2 | 8/2007 | Duplan et al. |
| 7,374,662 | B2 | 5/2008 | Duplan et al. |
| 7,425,662 | B2 | 9/2008 | Stanat et al. |
| 7,476,773 | B2 | 1/2009 | Louret et al. |
| 7,572,946 | B2 | 8/2009 | Lacombe et al. |
| 7,579,513 | B2 | 8/2009 | Duplan et al. |
| 7,589,244 | B2 | 9/2009 | Coupard et al. |
| 7,611,678 | B2 | 11/2009 | Louret et al. |
| 7,847,037 | B2 | 12/2010 | Simon |
| 8,178,740 | B2 | 5/2012 | Nicholas et al. |
| 8,222,470 | B2 | 7/2012 | Coupard et al. |
| 8,461,405 | B2 | 6/2013 | Sanchez et al. |
| 8,470,165 | B2 | 6/2013 | Cosyns et al. |
| 8,491,781 | B2 | 7/2013 | Gauthier et al. |
| 2004/0006250 | A1 | 1/2004 | Mathys et al. |
| 2004/0133053 | A1 | 7/2004 | Martens et al. |
| 2005/0049448 | A1 | 3/2005 | Loescher et al. |
| 2005/0121361 | A1 | 6/2005 | Duplan et al. |
| 2005/0182284 | A1 | 8/2005 | Stanat et al. |
| 2007/0049781 | A1* | 3/2007 | Brown et al. ..... 585/517 |
| 2008/0039669 | A1 | 2/2008 | Brown et al. |
| 2009/0292152 | A1 | 11/2009 | Brown et al. |
| 2010/0036182 | A1 | 2/2010 | Forestiere et al. |
| 2010/0056834 | A1 | 3/2010 | Phillion et al. |
| 2010/0081852 | A1 | 4/2010 | Louret et al. |
| 2010/0113847 | A1 | 5/2010 | Kowalik et al. |
| 2010/0158767 | A1 | 6/2010 | Mehlberg et al. |
| 2010/0331591 | A1 | 12/2010 | Brown et al. |
| 2011/0124936 | A1 | 5/2011 | Cabiac et al. |
| 2011/0172482 | A1 | 7/2011 | Cabiac et al. |
| 2011/0230690 | A1 | 9/2011 | Tiita et al. |

(Continued)

FOREIGN PATENT DOCUMENTS

| | | | |
|---|---|---|---|
| EP | 0392590 | A1 | 10/1990 |
| EP | 0800568 | B1 | 10/1997 |

(Continued)

OTHER PUBLICATIONS

De Klerk, "Oligomerization of 1-Hexene and 1-Octene over Solid Acid Catalysts", Ind. Eng. Chem. Res. 2005, 44, 3887-3893.
Pater, "1-Hexene Oligomerization in Liquid, Vapor, and Supercritical Phases over Beidellite and Ultrastable Y Zeolite Catalysts", Journal of Catalysis 179, 477-482 (1998).
Quann, "Chemistry of Olefin Oligomerization over ZSM-5 Catalyst", Ind. Eng. Chem. Res. 1988, 27, 565-570.
Van Grieken, "Liquid phase oligomerization of 1-hexene over different mesoporous aluminosilicates (AI-MTS, AI-MCM-41 and AI-SBA-15) and micrometer/nanometer HZSM-5 zeolites", Applied Catalysis A: General 305 (2006) 176-188.
U.S. Appl. No. 14/108,585, filed Dec. 17, 2013.
U.S. Appl. No. 14/108,594, filed Dec. 17, 2013.
U.S. Appl. No. 14/108,623, filed Dec. 17, 2013.
U.S. Appl. No. 14/108,636, filed Dec. 17, 2013.
Search Report dated Mar. 6, 2015 for corresponding PCT Appl. No. PCT/US2014/068505.

(Continued)

*Primary Examiner* — Nathan M Nutter

(57) ABSTRACT

A first oligomerization stream is oligomerized over a first catalyst in a first oligomerization reactor zone to make oligomerate. An oligomerate stream is separated to provide a heavy oligomerate boiling in the diesel range and a second oligomerization feed stream. The latter is fed to a second oligomerization reactor zone with a second different catalyst to produce the heavy oligomerate.

15 Claims, 8 Drawing Sheets

(56) References Cited

U.S. PATENT DOCUMENTS

| | | | |
|---|---|---|---|
| 2011/0282120 | A1 | 11/2011 | Buchanan et al. |
| 2012/0029255 | A1 | 2/2012 | Digne et al. |
| 2012/0116141 | A1 | 5/2012 | Godsmark et al. |
| 2013/0037446 | A1 | 2/2013 | Minoux et al. |
| 2013/0079574 | A1 | 3/2013 | Luebke et al. |
| 2013/0180884 | A1 | 7/2013 | Minoux et al. |
| 2013/0261359 | A1 | 10/2013 | da Silva Ferreira Alves et al. |
| 2014/0135543 | A1* | 5/2014 | Nicholas et al. ..... 585/300 |
| 2015/0166424 | A1* | 6/2015 | Vanden Bussche et al. ..... C07C 4/06 |
| 2015/0166432 | A1* | 6/2015 | Krupa et al. ..... C07C 2/08 |

FOREIGN PATENT DOCUMENTS

| | | | |
|---|---|---|---|
| EP | 0673352 | B1 | 4/1999 |
| WO | 2011138520 | A2 | 11/2011 |
| WO | 2013013884 | A2 | 1/2013 |

OTHER PUBLICATIONS

De Klerk, Arno et al., "Oligomerization of Fischer-Tropsch Olefins: Effect of Feed and Operating Conditions on Hydrogenated Motor-Gasoline Quality", Ind. Eng. Chem. Res., 2004, 43, 7449-7455.

* cited by examiner

PROCESS FOR OLIGOMERIZATION OF GASOLINE TO MAKE DIESEL

FIELD

The field of the invention is the oligomerization of light olefins to heavier oligomers to provide gasoline.

BACKGROUND

When oligomerizing light olefins within a refinery, there is frequently a desire to have the flexibility to make high octane gasoline, high cetane diesel, or combination of both. However, catalysts that make high octane gasoline typically make product that is highly branched and within the gasoline boiling point range. This product is very undesirable for diesel. In addition, catalysts that make high cetane diesel typically make product that is more linear and in the distillate boiling point range. This results in less and poorer quality gasoline due to the more linear nature of the product which has a lower octane value.

The oligomerization of butenes is often associated with a desire to make a high yield of high quality gasoline product. There is typically a limit as to what can be achieved when oligomerizing butenes. When oligomerizing butenes, dimerization is desired to obtain gasoline-range material. However, trimerization and higher oligomerization can occur which can produce material heavier than gasoline such as diesel. Efforts to produce diesel by oligomerization have failed to provide high yields except through multiple passes.

It would be desirable to produce high volumes of quality distillate by oligomerization.

SUMMARY

To increase oligomerate diesel production, olefins are oligomerized over a first catalyst to make gasoline range oligomerate. The gasoline range oligomerate is separated from lighter oligomerate and oligomerized over a different second catalyst to make heavier oligomerate than may be in the distillate range.

An embodiment is a process for oligomerization comprising passing a first oligomerization feed stream comprising $C_4$ olefins to an oligomerization reactor zone comprising a first catalyst to oligomerize $C_4$ olefins in the oligomerization feed stream to produce a first oligomerate stream; separating the oligomerate stream from the oligomerization reactor zone in a recovery zone to provide a second oligomerization feed stream and a heavy stream; passing the second oligomerization feed stream to a second oligomerization reactor zone comprising a second catalyst different from the first catalyst to produce a second oligomerate stream.

DEFINITIONS

Figure 1:
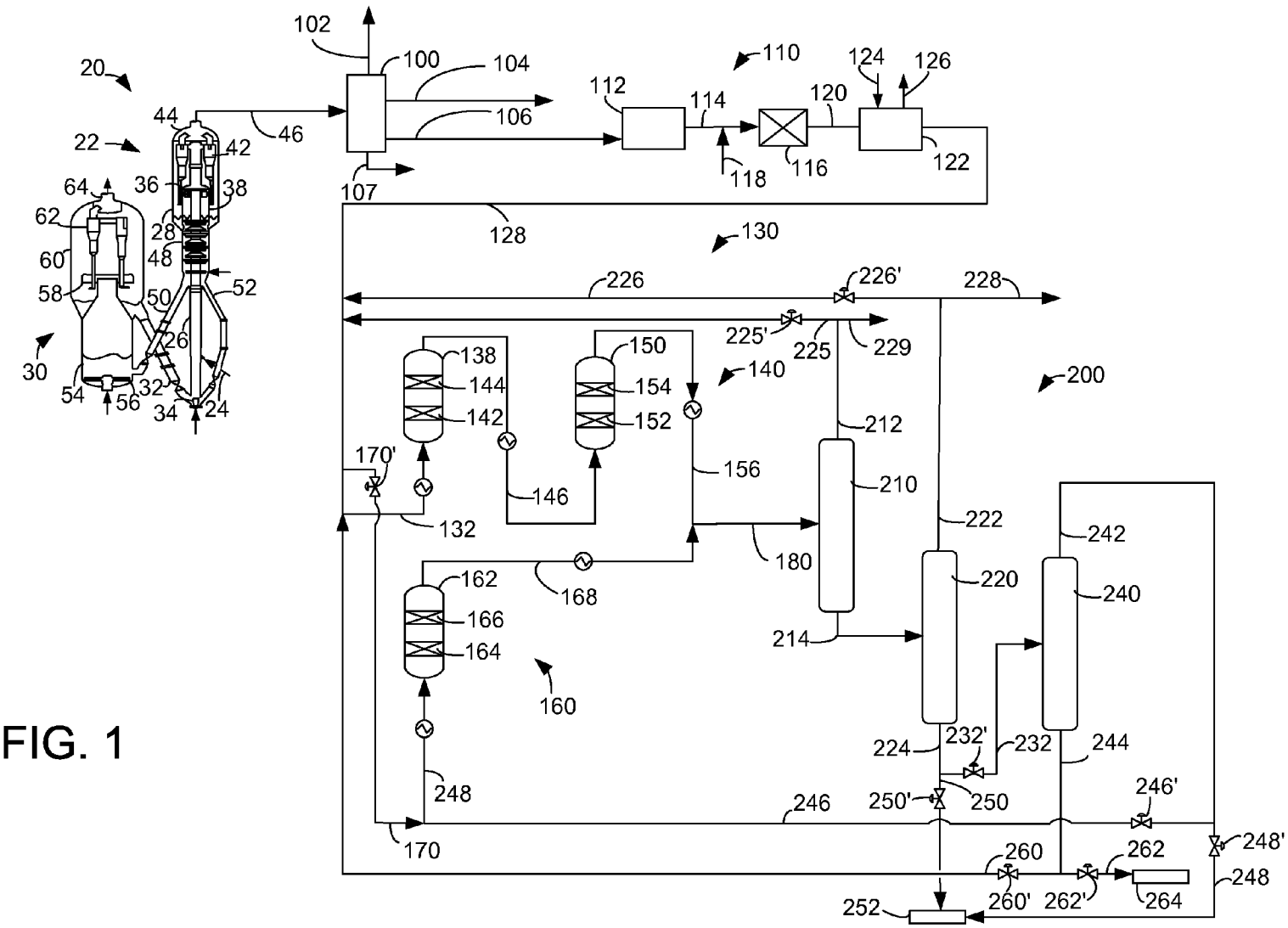
FIG. 1 is a schematic drawing of the present invention.

As used herein, the term "stream" can include various hydrocarbon molecules and other substances. Moreover, the term "stream comprising $C_x$ hydrocarbons" or "stream comprising $C_x$ olefins" can include a stream comprising hydrocarbon or olefin molecules, respectively, with "x" number of carbon atoms, suitably a stream with a majority of hydrocarbons or olefins, respectively, with "x" number of carbon atoms and preferably a stream with at least 75 wt % hydrocarbons or olefin molecules, respectively, with "x" number of carbon atoms. Moreover, the term "stream comprising $C_x$+ hydrocarbons" or "stream comprising $C_x$+ olefins" can include a stream comprising a majority of hydrocarbon or olefin molecules, respectively, with more than or equal to "x" carbon atoms and suitably less than 10 wt % and preferably less than 1 wt % hydrocarbon or olefin molecules, respectively, with x−1 carbon atoms. Lastly, the term "$C_x$-stream" can include a stream comprising a majority of hydrocarbon or olefin molecules, respectively, with less than or equal to "x" carbon atoms and suitably less than 10 wt % and preferably less than 1 wt % hydrocarbon or olefin molecules, respectively, with x+1 carbon atoms.

As used herein, the term "zone" can refer to an area including one or more equipment items and/or one or more sub-zones. Equipment items can include one or more reactors or reactor vessels, heaters, exchangers, pipes, pumps, compressors, controllers and columns. Additionally, an equipment item, such as a reactor, dryer, or vessel, can further include one or more zones or sub-zones.

As used herein, the term "substantially" can mean an amount of at least generally about 70%, preferably about 80%, and optimally about 90%, by weight, of a compound or class of compounds in a stream.

As used herein, the term "gasoline" can include hydrocarbons having a boiling point temperature in the range of about 25° to about 200° C. at atmospheric pressure.

As used herein, the term "diesel" or "distillate" can include hydrocarbons having a boiling point temperature in the range of about 150° to about 400° C. and preferably about 200° to about 400° C.

As used herein, the term "vacuum gas oil" (VGO) can include hydrocarbons having a boiling temperature in the range of from 343° to 552° C.

As used herein, the term "vapor" can mean a gas or a dispersion that may include or consist of one or more hydrocarbons.

As used herein, the term "overhead stream" can mean a stream withdrawn at or near a top of a vessel, such as a column.

As used herein, the term "bottom stream" can mean a stream withdrawn at or near a bottom of a vessel, such as a column.

As depicted, process flow lines in the figures can be referred to interchangeably as, e.g., lines, pipes, feeds, gases, products, discharges, parts, portions, or streams.

As used herein, "bypassing" with respect to a vessel or zone means that a stream does not pass through the zone or vessel bypassed although it may pass through a vessel or zone that is not designated as bypassed.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottom stream back to the bottom of the column. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column.

As used herein, the term "boiling point temperature" means atmospheric equivalent boiling point (AEBP) as calculated from the observed boiling temperature and the distillation pressure, as calculated using the equations furnished in ASTM D1160 appendix A7 entitled "Practice for Converting Observed Vapor Temperatures to Atmospheric Equivalent Temperatures".

As used herein, "taking a stream from" means that some or all of the original stream is taken.

DETAILED DESCRIPTION

The present invention is a process that can be used to make gasoline and primarily diesel. The process may be described with reference to five components shown in FIG. 1: an optional fluid catalytic cracking (FCC) zone 20, an optional FCC recovery zone 100, a purification zone 110, an oligomerization zone 130, and an oligomerization recovery zone 200. Many configurations of the present invention are possible, but specific embodiments are presented herein by way of example. All other possible embodiments for carrying out the present invention are considered within the scope of the present invention.

The FCC zone 20 is an optional way to provide an oligomerization feed stream for the present process. The FCC zone 20 may comprise an FCC reactor 22 and a regenerator vessel 30.

A conventional FCC feedstock and higher boiling hydrocarbon feedstock are a suitable FCC hydrocarbon feed 24 to the FCC reactor. The most common of such conventional feedstocks is a VGO. Higher boiling hydrocarbon feedstocks to which this invention may be applied include heavy bottom from crude oil, heavy bitumen crude oil, shale oil, tar sand extract, deasphalted residue, products from coal liquefaction, atmospheric and vacuum reduced crudes and mixtures thereof.

The FCC reactor 22 may include a reactor riser 26 and a reactor vessel 28. A regenerator catalyst pipe 32 delivers regenerated catalyst from the regenerator vessel 30 to the reactor riser 26. A fluidization medium such as steam from a distributor 34 urges a stream of regenerated catalyst upwardly through the reactor riser 26. At least one feed distributor injects the hydrocarbon feed in a hydrocarbon feed line 24, preferably with an inert atomizing gas such as steam, across the flowing stream of catalyst particles to distribute hydrocarbon feed to the reactor riser 26. Upon contacting the hydrocarbon feed with catalyst in the reactor riser 26 the heavier hydrocarbon feed cracks to produce lighter gaseous cracked products while coke is deposited on the catalyst particles to produce spent catalyst.

The resulting mixture of gaseous product hydrocarbons and spent catalyst continues upwardly through the reactor riser 26 and are received in the reactor vessel 28 in which the spent catalyst and gaseous product are separated. Disengaging arms discharge the mixture of gas and catalyst from a top of the reactor riser 26 through outlet ports 36 into a disengaging vessel 38 that effects partial separation of gases from the catalyst. A transport conduit carries the hydrocarbon vapors, stripping media and entrained catalyst to one or more cyclones 42 in the reactor vessel 28 which separates spent catalyst from the hydrocarbon gaseous product stream. Gas conduits deliver separated hydrocarbon cracked gaseous streams from the cyclones 42 to a collection plenum 44 for passage of a cracked product stream to a cracked product line 46 via an outlet nozzle and eventually into the FCC recovery zone 100 for product recovery.

Diplegs discharge catalyst from the cyclones 42 into a lower bed in the reactor vessel 28. The catalyst with adsorbed or entrained hydrocarbons may eventually pass from the lower bed into a stripping section 48 across ports defined in a wall of the disengaging vessel 38. Catalyst separated in the disengaging vessel 38 may pass directly into the stripping section 48 via a bed. A fluidizing distributor delivers inert fluidizing gas, typically steam, to the stripping section 48. The stripping section 48 contains baffles or other equipment to promote contacting between a stripping gas and the catalyst. The stripped spent catalyst leaves the stripping section 48 of the disengaging vessel 38 of the reactor vessel 28 stripped of hydrocarbons. A first portion of the spent catalyst, preferably stripped, leaves the disengaging vessel 38 of the reactor vessel 28 through a spent catalyst conduit 50 and passes into the regenerator vessel 30. A second portion of the spent catalyst may be recirculated in recycle conduit 52 from the disengaging vessel 38 back to a base of the riser 26 at a rate regulated by a slide valve to recontact the feed without undergoing regeneration.

The riser 26 can operate at any suitable temperature, and typically operates at a temperature of about 150° to about 580° C. at the riser outlet 36. The pressure of the riser is from about 69 to about 517 kPa (gauge) (10 to 75 psig) but typically less than about 275 kPa (gauge) (40 psig). The catalyst-to-oil ratio, based on the weight of catalyst and feed hydrocarbons entering the riser, may range up to 30:1 but is typically between about 4:1 and about 25:1. Steam may be passed into the reactor riser 26 and the reactor vessel 28 at a rate between about 2 and about 7 wt % for maximum gasoline production and about 10 to about 30 wt % for maximum light olefin production. The average residence time of catalyst in the riser may be less than about 5 seconds.

The catalyst in the reactor 22 can be a single catalyst or a mixture of different catalysts. Usually, the catalyst includes two catalysts, namely a first FCC catalyst, and a second FCC catalyst. Such a catalyst mixture is disclosed in, e.g., U.S. Pat. No. 7,312,370 B2. Generally, the first FCC catalyst may include any of the well-known catalysts that are used in the art of FCC. Preferably, the first FCC catalyst includes a large pore zeolite, such as a Y-type zeolite, an active alumina material, a binder material, including either silica or alumina, and an inert filler such as kaolin.

Typically, the zeolites appropriate for the first FCC catalyst have a large average pore size, usually with openings of greater than about 0.7 nm in effective diameter defined by greater than about 10, and typically about 12, member rings. Suitable large pore zeolite components may include synthetic zeolites such as X and Y zeolites, mordenite and faujasite. A portion of the first FCC catalyst, such as the zeolite portion, can have any suitable amount of a rare earth metal or rare earth metal oxide.

The second FCC catalyst may include a medium or smaller pore zeolite catalyst, such as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second component has the medium or smaller pore zeolite dispersed on a matrix including a binder material such as silica or alumina and an inert filler material such as kaolin. These catalysts may have a crystalline zeolite content of about 10 to about 50 wt % or more, and a matrix material content of about 50 to about 90 wt %. Catalysts containing at least about 40 wt % crystalline zeolite material are typical, and those with greater crystalline zeolite content may be used. Generally, medium and smaller pore zeolites are characterized by having an effective pore opening diameter of less than or equal to about 0.7 nm and rings of about 10 or fewer members. Preferably, the second FCC catalyst component is an MFI zeolite having a silicon-to-aluminum ratio greater than about 15. In one exemplary embodiment, the silicon-to-aluminum ratio can be about 15 to about 35.

The total catalyst mixture in the reactor 22 may contain about 1 to about 25 wt % of the second FCC catalyst, including a medium to small pore crystalline zeolite, with greater than or equal to about 7 wt % of the second FCC catalyst being preferred. When the second FCC catalyst contains about 40 wt % crystalline zeolite with the balance being a binder material, an inert filler, such as kaolin, and optionally an active alumina component, the catalyst mixture may contain about 0.4 to about 10 wt % of the medium to small pore crystalline zeolite with a preferred content of at least about 2.8 wt %. The first FCC catalyst may comprise the balance of the catalyst composition. The high concentration of the medium or smaller pore zeolite as the second FCC catalyst of the catalyst mixture can improve selectivity to light olefins. In one exemplary embodiment, the second FCC catalyst can be a ZSM-5 zeolite and the catalyst mixture can include about 0.4 to about 10 wt % ZSM-5 zeolite excluding any other components, such as binder and/or filler.

The regenerator vessel 30 is in downstream communication with the reactor vessel 28. In the regenerator vessel 30, coke is combusted from the portion of spent catalyst delivered to the regenerator vessel 30 by contact with an oxygen-containing gas such as air to regenerate the catalyst. The spent catalyst conduit 50 feeds spent catalyst to the regenerator vessel 30. The spent catalyst from the reactor vessel 28 usually contains carbon in an amount of from 0.2 to 7 wt %, which is present in the form of coke. An oxygen-containing combustion gas, typically air, enters the lower chamber 54 of the regenerator vessel 30 through a conduit and is distributed by a distributor 56. As the combustion gas enters the lower chamber 54, it contacts spent catalyst entering from spent catalyst conduit 50 and lifts the catalyst at a superficial velocity of combustion gas in the lower chamber 54 of perhaps at least 1.1 m/s (3.5 ft/s) under fast fluidized flow conditions. In an embodiment, the lower chamber 54 may have a catalyst density of from 48 to 320 kg/m$^3$ (3 to 20 lb/ft$^3$) and a superficial gas velocity of 1.1 to 2.2 m/s (3.5 to 7 ft/s). The oxygen in the combustion gas contacts the spent catalyst and combusts carbonaceous deposits from the catalyst to at least partially regenerate the catalyst and generate flue gas.

The mixture of catalyst and combustion gas in the lower chamber 54 ascends through a frustoconical transition section to the transport, riser section of the lower chamber 54. The mixture of catalyst particles and flue gas is discharged from an upper portion of the riser section into the upper chamber 60. Substantially completely or partially regenerated catalyst may exit the top of the transport, riser section. Discharge is effected through a disengaging device 58 that separates a majority of the regenerated catalyst from the flue gas. The catalyst and gas exit downwardly from the disengaging device 58. The sudden loss of momentum and downward flow reversal cause a majority of the heavier catalyst to fall to the dense catalyst bed and the lighter flue gas and a minor portion of the catalyst still entrained therein to ascend upwardly in the upper chamber 60. Cyclones 62 further separate catalyst from ascending gas and deposits catalyst through dip legs into a dense catalyst bed. Flue gas exits the cyclones 62 through a gas conduit and collects in a plenum 64 for passage to an outlet nozzle of regenerator vessel 30. Catalyst densities in the dense catalyst bed are typically kept within a range of from about 640 to about 960 kg/m$^3$ (40 to 60 lb/ft$^3$).

The regenerator vessel 30 typically has a temperature of about 594° to about 704° C. (1100° to 1300° F.) in the lower chamber 54 and about 649° to about 760° C. (1200° to 1400° F.) in the upper chamber 60. Regenerated catalyst from dense catalyst bed is transported through regenerated catalyst pipe 32 from the regenerator vessel 30 back to the reactor riser 26 through the control valve where it again contacts the feed in line 24 as the FCC process continues. The cracked product stream in the cracked product line 46 from the reactor 22, relatively free of catalyst particles and including the stripping fluid, exit the reactor vessel 28 through an outlet nozzle.

The cracked products stream in the line 46 may be subjected to additional treatment to remove fine catalyst particles or to further prepare the stream prior to fractionation. The line 46 transfers the cracked products stream to the FCC recovery zone 100, which is in downstream communication with the FCC zone 20. The FCC recovery zone 100 typically includes a main fractionation column and a gas recovery section. The FCC recovery zone can include many fractionation columns and other separation equipment. The FCC recovery zone 100 can recover a propylene product stream in propylene line 102, a gasoline stream in gasoline line 104, a light olefin stream in light olefin line 106 and an LCO stream in LCO line 107 among others from the cracked product stream in the cracked product line 46. The light olefin stream in light olefin line 106 comprises an oligomerization feed stream having $C_4$ hydrocarbons including $C_4$ olefins and perhaps having $C_5$ hydrocarbons including $C_5$ olefins.

Before cracked products can be fed to the oligomerization zone 130, the light olefin stream in light olefin line 106 may require purification. Many impurities in the light olefin stream in light olefin line 106 can poison an oligomerization catalyst. Carbon dioxide and ammonia can attack acid sites on the catalyst. Sulfur containing compounds, oxygenates, and nitriles can harm oligomerization catalyst. Acetylenes and diolefins can polymerize and produce gums on the catalyst or equipment. Consequently, the light olefin stream which comprises the oligomerization feed stream in light olefin line 106 may be purified in an optional purification zone 110.

The light olefin stream in light olefin line 106 may be introduced into an optional mercaptan extraction unit 112 to remove mercaptans to lower concentrations. In the mercaptan extraction unit 112, the light olefin feed may be prewashed in an optional prewash vessel containing aqueous alkali to convert any hydrogen sulfide to sulfide salt which is soluble in the aqueous alkaline stream. The light olefin stream, now depleted of any hydrogen sulfide, is contacted with a more concentrated aqueous alkali stream in an extractor vessel. Mercaptans in the light olefin stream react with the alkali to yield sodium mercaptides that are soluble in the aqueous alkali phase but not in the hydrocarbon phase. An extracted light olefin stream depleted in mercaptans passes overhead from the extraction column and may be mixed with a solvent that removes COS in route to an optional COS solvent settler. COS may be removed with the solvent from the bottom of the settler, while the overhead light olefin stream may be fed to an optional water wash vessel to remove remaining alkali and produce a sulfur depleted light olefin stream in line 114. The mercaptide rich alkali from the extractor vessel receives an injection of air and a catalyst such as phthalocyanine as it passes from the extractor vessel to an oxidation vessel for regeneration. Oxidizing the mercaptides to disulfides using a catalyst regenerates the alkaline solution. A disulfide separator receives the disulfide rich alkaline from the oxidation vessel. The disulfide separator vents excess air and decants disulfides from the alkaline solution before the regenerated alkaline is drained, washed with oil to remove remaining disulfides and returned to the extractor vessel. Further removal of disulfides from the regenerated alkaline stream is also contemplated. The disulfides may be run through a sand filter and removed from the process. For more information on mercaptan extraction, reference may be made to U.S. Pat. No. 7,326,333 B2.

In order to prevent polymerization and gumming in the oligomerization reactor that can inhibit equipment and catalyst performance, it is desired to minimize diolefins and acetylenes in the light olefin feed in line 114. Diolefin conversion to monoolefin hydrocarbons may be accomplished by selectively hydrogenating the sulfur depleted stream with a conventional selective hydrogenation reactor 116. Hydrogen may be added to the purified light olefin stream in line 118.

The selective hydrogenation catalyst can comprise an alumina support material preferably having a total surface area greater than 150 $m^2/g$, with most of the total pore volume of the catalyst provided by pores with average diameters of greater than 600 angstroms, and containing surface deposits of about 1.0 to 25.0 wt % nickel and about 0.1 to 1.0 wt % sulfur such as disclosed in U.S. Pat. No. 4,695,560. Spheres having a diameter between about 0.4 and 6.4 mm (1/64 and 1/4 inch) can be made by oil dropping a gelled alumina sol. The alumina sol may be formed by digesting aluminum metal with an aqueous solution of approximately 12 wt % hydrogen chloride to produce an aluminum chloride sol. The nickel component may be added to the catalyst during the sphere formation or by immersing calcined alumina spheres in an aqueous solution of a nickel compound followed by drying, calcining, purging and reducing. The nickel containing alumina spheres may then be sulfided. A palladium catalyst may also be used as the selective hydrogenation catalyst.

The selective hydrogenation process is normally performed at relatively mild hydrogenation conditions. These conditions will normally result in the hydrocarbons being present as liquid phase materials. The reactants will normally be maintained under the minimum pressure sufficient to maintain the reactants as liquid phase hydrocarbons which allow the hydrogen to dissolve into the light olefin feed. A broad range of suitable operating pressures therefore extends from about 276 (40 psig) to about 5516 kPa gauge (800 psig). A relatively moderate temperature between about 25° C. (77° F.) and about 350° C. (662° F.) should be employed. The liquid hourly space velocity of the reactants through the selective hydrogenation catalyst should be above 1.0 $hr^{-1}$. Preferably, it is between 5.0 and 35.0 $hr^{-1}$. The molar ratio of hydrogen to diolefinic hydrocarbons may be maintained between 1.5:1 and 2:1. The hydrogenation reactor is preferably a cylindrical fixed bed of catalyst through which the reactants move in a vertical direction.

A purified light olefin stream depleted of sulfur containing compounds, diolefins and acetylenes exits the selective hydrogenation reactor 116 in line 120. The optionally sulfur and diolefin depleted light olefin stream in line 120 may be introduced into an optional nitrile removal unit (NRU) such as a water wash unit 122 to reduce the concentration of oxygenates and nitriles in the light olefin stream in line 120. Water is introduced to the water wash unit in line 124. An oxygenate and nitrile-rich aqueous stream in line 126 leaves the water wash unit 122 and may be further processed. A drier may follow the water wash unit 122. Other NRU's may be used in place of the water wash. An NRU usually consists of a group of regenerable beds that adsorb the nitriles and other nitrogen components from the light olefin stream. Examples of NRU's can be found in U.S. Pat. Nos. 4,831,206, 5,120,881 and 5,271,835.

A purified light olefin oligomerization feed stream perhaps depleted of sulfur containing compounds, diolefins and/or oxygenates and nitriles is provided in oligomerization feed stream line 128. The light olefin oligomerization feed stream in line 128 may be obtained from the cracked product stream in line 46, so it may be in downstream communication with the FCC zone 20 and/or the FCC recovery zone 100. The oligomerization feed stream need not be obtained from a cracked FCC product stream but may come from another source such as a paraffin dehydrogenation unit or a methanol-to-olefin unit. The selective hydrogenation reactor 116 is in upstream communication with the oligomerization feed stream line 128. The oligomerization feed stream may comprise $C_4$ hydrocarbons such as butenes, i.e., $C_4$ olefins, and butanes. Butenes include normal butenes and isobutene. The oligomerization feed stream in oligomerization feed stream line 128 may comprise $C_5$ hydrocarbons such as pentenes, i.e., $C_5$ olefins, and pentanes. Pentenes include normal pentenes and isopentenes. Typically, the oligomerization feed stream will comprise about 20 to about 80 wt % olefins and suitably about 40 to about 75 wt % olefins. In an aspect, about 55 to about 75 wt % of the olefins may be butenes and about 25 to about 45 wt % of the olefins may be pentenes. Up to 10 wt %, suitably 20 wt %, typically 25 wt % and most typically 30 wt % of the oligomerization feed may be $C_5$ olefins.

The oligomerization feed line 128 feeds the oligomerization feed stream to an oligomerization zone 130 which may be in downstream communication with the FCC recovery zone 100. The oligomerization feed stream in oligomerization feed line 128 may be mixed with recycle streams from line 225, 226 or 260 prior to entering the oligomerization zone 130 to provide a first oligomerization feed stream in a first oligomerization feed conduit 132. A first oligomerization reactor zone 140 is in downstream communication with the first oligomerization feed conduit 132.

A first oligomerization feed bypass stream from the first oligomerization feed stream in the oligomerization feed line 128 may transport a bypass stream comprising the oligomerization feed stream mixed with recycle streams from lines 225 or 226 but not 260 around the first oligomerization reactor zone 140 to a second oligomerization reactor zone 160 in a bypass line 170. Flow through the bypass line 170 can be regulated by control valve 170' which can completely shut off flow through the bypass line 170 or allow partial or full flow therethrough.

The first oligomerization feed stream in the first oligomerization feed conduit 132 may comprise about 10 to about 50 wt % olefins and suitably about 25 to about 40 wt % olefins. The oligomerization feed stream may comprise no more than about 38 wt % butene and in another aspect, the oligomerization feed stream may comprise no more than about 23 wt % pentene. The first oligomerization feed stream to the oligomerization zone 130 in the first oligomerization feed conduit 132 may comprise at least about 10 wt % butene, at least about 5 wt % pentene and preferably no more than about 1 wt % hexene. In a further aspect, the oligomerization feed stream may comprise no more than about 0.1 wt % hexene and no more than about 0.1 wt % propylene. At least about 40 wt % of the butene in the oligomerization feed stream may be normal butene. In an aspect, it may be that no more than about 70 wt % of the oligomerization feed stream is normal butene. At least about 40 wt % of the pentene in the oligomerization feed stream may be normal pentene. In an aspect, no more than about 70 wt % of the oligomerization feed stream in the first oligomerization feed conduit 132 may be normal pentene.

The first oligomerization reactor zone 140 comprises a first oligomerization reactor 138. The first oligomerization reactor 138 contains a first oligomerization catalyst. An oligomerization feed stream may be preheated before entering the first oligomerization reactor 138 in the first oligomerization reactor zone 140. The first oligomerization reactor 138 may contain a first catalyst bed 142 of the first oligomerization catalyst. The first oligomerization reactor 138 may be an upflow reactor to provide a uniform feed front through the catalyst bed, but other flow arrangements are contemplated. In an aspect, the first oligomerization reactor 138 may contain an additional bed or beds 144 of the first oligomerization catalyst. $C_4$ olefins in the oligomerization feed stream oligomerize over the first oligomerization catalyst to provide an oligomerate comprising $C_4$ olefin dimers and trimers. $C_5$ olefins that may be present in the oligomerization feed stream oligomerize over the first oligomerization catalyst to provide an oligomerate comprising $C_5$ olefin dimers and trimers and co-oligomerize with $C_4$ olefins to make $C_9$ olefins. The oligomerization produces other oligomers with additional carbon numbers.

Oligomerization effluent from the first bed 142 may optionally be quenched with a liquid such as recycled oligomerate, a portion of the oligomerization feed from the first oligomerization feed conduit 132, or a portion of the overhead recycle stream from the light recycle line 225 or the intermediate recycle line 226. Other means of controlling the reaction exotherm are also envisioned, such as the use of coolers between catalyst beds to remove heat before entering the additional bed 144. The liquid oligomerate may also comprise oligomerized olefins that can react with the $C_4$ olefins and $C_5$ olefins in the feed and other oligomerized olefins if present to make diesel range olefins. Oligomerized product, also known as oligomerate, exits the first oligomerization reactor 138 in line 146.

In an aspect, the first oligomerization reactor zone 140 may include one or more additional oligomerization reactors 150. The oligomerization effluent may be heat exchanged and fed to the optional additional oligomerization reactor 150. It is contemplated that the first oligomerization reactor 138 and the additional oligomerization reactor 150 may be operated in a swing bed fashion to take one reactor offline for maintenance or catalyst regeneration or replacement while the other reactor stays online. In an aspect, the additional oligomerization reactor 150 may contain a first bed 152 of oligomerization catalyst. The additional oligomerization reactor 150 may also be an upflow reactor to provide a uniform feed front through the catalyst bed, but other flow arrangements are contemplated. In an aspect, the additional oligomerization reactor 150 may contain an additional bed or beds 154 of the first oligomerization catalyst. Remaining $C_4$ olefins in the oligomerization feed stream oligomerize over the oligomerization catalyst to provide an oligomerate comprising $C_4$ olefin dimers and trimers. Remaining $C_5$ olefins, if present in the oligomerization feed stream, oligomerize over the first oligomerization catalyst to provide an oligomerate comprising $C_5$ olefin dimers and trimers and co-oligomerize with $C_4$ olefins to make $C_9$ olefins. Over 90 wt % of the $C_4$ olefins in the oligomerization feed stream can oligomerize in the first oligomerization reactor zone 140. Over 90 wt % of the $C_5$ olefins in the oligomerization feed stream can oligomerize in the first oligomerization reactor zone 140. If more than one oligomerization reactor is used, conversion is achieved over all of the oligomerization reactors 138, 150 in the first oligomerization reactor zone 140.

Oligomerization effluent from the first bed 152 may be quenched with a liquid such as recycled oligomerate, a portion of the oligomerization feed from the first oligomerization feed conduit 132, or a portion of the overhead recycle stream coming from the light recycle line 225 or the intermediate recycle line 226 before entering the additional bed 154. Other means of controlling the reaction exotherm are also envisioned, such as the use of coolers between catalyst beds to remove heat. The recycled oligomerate may also comprise oligomerized olefins that can react with the $C_4$ olefins and $C_5$ olefins in the feed and other oligomerized olefins to increase production of diesel range olefins.

We have found that adding $C_5$ olefins to the feed to the oligomerization reactor reduces oligomerization to heavier, distillate range material. However, when $C_5$ olefins dimerize with themselves or co-dimerize with $C_4$ olefins, the $C_9$ olefins and $C_{10}$ olefins produced do not continue to oligomerize as quickly as $C_8$ olefins produced from $C_4$ olefin dimerization. Thus, the amount of net gasoline produced can be increased, but this may decrease the distillate produced.

A first oligomerate conduit 156, in downstream communication with the first oligomerization reactor zone 140, withdraws an oligomerate stream from the first oligomerization reactor zone 140. The first oligomerate conduit 156 may be in downstream communication with the first oligomerization reactor 138 and the additional oligomerization reactor 150.

The first oligomerization catalyst may be a solid phosphoric acid catalyst (SPA). The SPA catalyst refers to a solid catalyst that contains as a principal ingredient an acid of phosphorous such as ortho-, pyro- or tetraphosphoric acid. SPA catalyst is normally formed by mixing the acid of phosphorous with a siliceous solid carrier to form a wet paste. This paste may be calcined and then crushed to yield catalyst particles or the paste may be extruded or pelleted prior to calcining to produce more uniform catalyst particles. The carrier is preferably a naturally occurring porous silica-containing material such as kieselguhr, kaolin, infusorial earth and diatomaceous earth. A minor amount of various additives such as mineral talc, fuller's earth and iron compounds including iron oxide may be added to the carrier to increase its strength and hardness. The combination of the carrier and the additives preferably comprises about 15-30 wt % of the catalyst, with the remainder being the phosphoric acid. The additive may comprise about 3-20 wt % of the total carrier material. Variations from this composition such as a lower phosphoric acid content are possible. Further details as to the composition and production of SPA catalysts may be obtained from U.S. Pat. Nos. 3,050,472, 3,050,473 and 3,132,109. Feed to the second oligomerization reactor zone 160 should be kept dry except in an initial start-up phase.

The oligomerization reaction conditions in the oligomerization reactors 138, 150 in the first oligomerization reactor zone 140 are set to keep the reactant fluids in the liquid phase. With liquid oligomerate recycle, lower pressures are necessary to maintain liquid phase. Operating pressures include between about 2.1 MPa (305 psia) and about 10.5 MPa (1520 psia), suitably at a pressure between about 2.1 MPa (300 psia) and about 6.9 MPa (1000 psia) and preferably at a pressure between about 2.8 MPa (400 psia) and about 4.1 MPa (600 psia). Lower pressures may be suitable as long as the reaction is kept in the liquid phase. The temperature of the oligomerization conditions in the first oligomerization reactor zone 140 is in a range between about 100° and about 250° C. and suitably between about 150° and about 200° C. to maximize distillate production. Although the first oligomerization reactor zone 140 primarily produces gasoline-range olefins, the overall process is designed to produce diesel-range olefins. Hence maximization of diesel production in the first oligomerization reactor zone 140 is appropriate. Across a single bed of oligomerization catalyst, the exothermic reaction will cause the temperature to rise. Consequently, the oligomerization reactor may be operated to allow the temperature at the outlet to be over about 25° C. greater than the temperature at the inlet.

The first oligomerization reactor zone 140 with the first oligomerization catalyst can be run in high conversion mode of greater than 95% conversion of feed olefins to produce a high quality diesel product and gasoline product. Normal butene conversion can exceed about 80%. Additionally, normal pentene conversion can exceed about 80%.

An oligomerization recovery zone 200 is in downstream communication with the first oligomerization reactor zone 140 and the first oligomerate conduit 156. The first oligomerate conduit 156 removes the oligomerate stream from the oligomerization zone 130 via a combined oligomerate conduit 180. The combined oligomerate conduit 180 is also in downstream communication with a second oligomerate stream in a second oligomerate conduit 168 to be explained hereafter. The first oligomerate stream and the second oligomerate stream may be transported together in the combined oligomerate conduit 180 to be separated in an oligomerization recovery zone 200 together.

The oligomerization recovery zone 200 may include a debutanizer column 210 which separates the oligomerate stream between vapor and liquid into a first vaporous oligomerate overhead light stream comprising $C_4$ olefins and hydrocarbons in a first overhead line 212 and a first liquid oligomerate bottom stream comprising $C_5$+ olefins and hydrocarbons in a first bottom line 214. When maximum production of distillate is desired, the overhead pressure in the debutanizer column 210 may be between about 300 and about 350 kPa (gauge) and the bottom temperature may be between about 250° and about 300° C.

The oligomerization recovery zone 200 may include a depentanizer column 220 to which the fir$_s$t liquid oligomerate bottom stream comprising $C_5$+ hydrocarbons may be fed in line 214. The depentanizer column 220 may separate the first liquid oligomerate bottom stream between vapor and liquid into an intermediate stream comprising $C_5$ olefins and hydrocarbons in an intermediate line 222 and a liquid oligomerate bottom product stream comprising $C_6$+ olefins in a bottom product line 224. When maximum production of distillate is desired, the overhead pressure in the depentanizer column 220 may be between about 50 and about 100 kPa (gauge) and the bottom temperature may be between about 200° and about 275° C.

It is desired to maintain liquid phase in the oligomerization reactors. This can be achieved by saturating product olefins and recycling them to the oligomerization reactor as a liquid. However, saturating olefins in the recycle to the first oligomerization reactor zone 140 would inactivate the recycle feed. The first oligomerization reactor zone 140 can only further oligomerize olefinic recycle. Liquid phase may be maintained in the first oligomerization reactor zone 140 by incorporating into the feed a $C_5$ stream from the oligomerization recovery zone 200.

The light stream in overhead line 212 may comprise at least 70 wt % and suitably at least 90 wt % $C_4$ hydrocarbons. The overhead intermediate stream comprising $C_4$ hydrocarbons may have less than 10 wt % $C_3$ or $C_5$ hydrocarbons and preferably less than 1 wt % $C_3$ or $C_5$ hydrocarbons.

The light stream in the overhead line 212 may be condensed and recycled to the first oligomerization reactor zone 140 as a first light recycle stream in a light recycle line 225 at a rate governed by control valve 225' to absorb heat generation therein and to oligomerize unreacted butenes in the oligomerization reactors 138, 150 operating in the first oligomerization reactor zone 140. The light stream may comprise $C_4$ olefins that can oligomerize in the first oligomerization reactor zone 140. The butanes are easily separated from the heavier olefinic product such as in the debutanizer column 210. The butane recycled to the oligomerization zone also dilutes the feed olefins to help limit the temperature rise within the oligomerization reactor due to the exothermicity of the reaction.

In an aspect, the light stream in the overhead line 212 comprising $C_4$ hydrocarbons may be split into a purge stream in purge line 229 and the light recycle stream comprising $C_4$ hydrocarbons in the light recycle line 225. In an aspect, the light recycle stream in the light recycle line 225 taken from the light stream in the overhead line 212 is recycled to the first oligomerization reactor zone 140 downstream of the selective hydrogenation reactor 116. The light stream in the overhead line 212 and the light recycle stream in the light recycle line 225 should be understood to be condensed overhead streams. The recycle rate may be adjusted as necessary to control temperature rise and/or to maximize selectivity to gasoline range oligomer products.

The purge stream comprising $C_4$ hydrocarbons taken from the light stream may be purged from the process in line 229 to avoid $C_4$ build up in the process. The purge stream comprising $C_4$ hydrocarbons in line 229 may be subjected to further processing to recover useful components.

The intermediate stream in intermediate line 222 may comprise at least 70 wt % and suitably at least 90 wt % $C_5$ hydrocarbons which can then act as a solvent in the first oligomerization reactor zone 140 to maintain liquid phase therein. The overhead intermediate stream comprising $C_5$ hydrocarbons should have less than 10 wt % $C_4$ or $C_6$ hydrocarbons and preferably less than 1 wt % $C_4$ or $C_6$ hydrocarbons.

The intermediate stream may be condensed and recycled to the first oligomerization reactor zone 140 as a intermediate recycle stream in an intermediate recycle line 226 at a rate governed by control valve 226' to maintain the liquid phase in the oligomerization reactors 138, 150 operating in the first oligomerization reactor zone 140. The intermediate stream may comprise $C_5$ olefins that can oligomerize in the oligomerization zone. The $C_5$ hydrocarbon presence in the oligomerization zone maintains the oligomerization reactors at liquid phase conditions. The pentanes are easily separated from the heavier olefinic product such as in the depentanizer column 220. The pentane recycled to the oligomerization zone also dilutes the feed olefins to help limit the temperature rise within the reactor caused by the exothermic oligomerization reactions.

In an aspect, the intermediate stream in the intermediate line 222 comprising $C_5$ hydrocarbons may be split into a purge stream in purge line 228 and the intermediate recycle stream comprising $C_5$ hydrocarbons in the intermediate recycle line 226. In an aspect, the intermediate recycle stream in intermediate recycle line 226 taken from the intermediate stream in intermediate line 222 is recycled to the first oligomerization reactor zone 140 downstream of the selective hydrogenation reactor 116. The intermediate stream in intermediate line 222 and the intermediate recycle stream in intermediate recycle line 226 should be understood to be condensed overhead streams. The recycle rate may be adjusted as necessary to maintain liquid phase in the oligomerization reactors, to control temperature rise, and to maximize selectivity to gasoline range oligomer products.

The purge stream comprising $C_5$ hydrocarbons taken from the intermediate stream may be purged from the process in line 228 to avoid $C_5$ paraffin build up in the process. The purge stream comprising $C_5$ hydrocarbons in line 228 may be subjected to further processing to recover useful components or be blended in the gasoline pool.

Two streams may be taken from the liquid oligomerate bottom product stream in bottom product line 224. A distillate separator feed stream in distillate feed line 232 may be taken from the liquid oligomerate bottom product stream in the bottom product line 224. Flow through distillate feed line 232 can be regulated by control valve 232'. In a further aspect, a gasoline oligomerate product stream in a gasoline oligomerate product line 250 can be taken from the liquid oligomerate bottom product stream in bottom product line 224. Flow through gasoline oligomerate product line 250 can be regulated by control valve 250'. Flow through the distillate feed line 232 and the gasoline oligomerate product line 250 can be regulated by control valves 232' and 250', respectively, such that flow through each line can be shut off or allowed irrespective of the other line.

Accordingly, the liquid oligomerate bottom product stream in bottom product line 224 provides gasoline range material. Consequently, a gasoline oligomerate product stream may be collected from the liquid oligomerate bottom product stream in a gasoline oligomerate product line 250 and blended in the gasoline pool without further treatment such as separation or chemical upgrading. The gasoline oligomerate product line 250 may be in upstream communication with a gasoline tank 252 or a gasoline blending line of a gasoline pool. However, further treatment such as partial or full hydrogenation to reduce olefinicity may be contemplated. In such a case, control valves 232' may be all or partially closed and control valve 250' on oligomerate liquid product line 250 may be opened to allow $C_6$+ gasoline product to be sent to the gasoline tank 252 or the gasoline blending line.

The oligomerization recovery zone 200 may also include a distillate separator column 240 to which the distillate separator oligomerate feed stream comprising oligomerate $C_6$+ hydrocarbons may be fed in distillate feed line 232 taken from the liquid oligomerate bottom product stream in line 224 for further separation. The distillate separator column 240 is in downstream communication with the first bottom line 214 of the debutanizer column 210 and the bottom product line 224 of the depentanizer column 220.

The distillate separator column 240 separates the distillate separator oligomerate feed stream into an gasoline overhead stream in an overhead line 242 comprising $C_6$, $C_7$, $C_8$, $C_9$, $C_{10}$ and/or $C_{11}$ olefins and a heavy oligomerate stream comprising $C_8$+, $C_9$+, $C_{10}$+, $C_{11}$+, or $C_{12}$+ olefins in a diesel bottom line 244. When maximum production of distillate is desired, the overhead pressure in the distillate separator column 240 may be between about 10 and about 60 kPa (gauge) and the bottom temperature may be between about 225° and about 275° C. The bottom temperature can be adjusted between about 175° and about 275° C. to adjust the bottom product between a $C_9$+ olefin cut and a $C_{12}$+ olefin cut based on the boiling point range of the diesel cut desired by the refiner. The heavy oligomerate stream in diesel bottoms line 244 may have greater than 30 wt % $C_9$+ isoolefins.

In an aspect, the gasoline overhead stream in gasoline overhead line 242 may be recovered as product in product gasoline line 248 in downstream communication with the recovery zone 200. The gasoline overhead stream may comprise less than 15 wt % $C_{12}$ olefins. A control valve 248' may be used to completely shut off flow through gasoline product line 248 or allow partial or full flow therethrough. The gasoline product stream may be subjected to further processing to recover useful components or blended in the gasoline pool. The gasoline product line 248 may be in upstream communication with a gasoline tank 252 or a gasoline blending line of a gasoline pool. In this aspect, the overhead line 242 of the distillate separator column may be in upstream communication with the gasoline tank 252 or the gasoline blending line.

When the first oligomerization catalyst in the first oligomerization reactor zone is SPA catalyst, oligomerate produce comprises mostly gasoline range olefins particularly when $C_5$ olefins are present in the first oligomerization feed. For refiners who seek to maximize distillate production, the gasoline overhead stream comprising $C_8$ olefins in the gasoline overhead line 242 of the distillate separator column can be recycled to the oligomerization zone 130 to increase the production of distillate. For example, a second oligomerization feed stream in a second oligomerization feed line 246 may be taken from the gasoline overhead stream in gasoline overhead line 242 and heated and fed to a second oligomerization reactor zone 160 in the oligomerization zone 130. A control valve 246' may be used to completely shut off flow through the second oligomerization feed line 246 or allow partial or full flow therethrough. The second oligomerization feed line 246 may be in downstream communication with the oligomerization recovery zone 200 for generating diesel range material. The second oligomerization feed stream in the second oligomerization feed line 246 may be joined by first oligomerization feed bypass stream that is bypassed around the first oligomerization reactor zone 140 in bypass line 170. A combined second oligomerization feed stream in a combined second oligomerization feed line 248 is fed to the second oligomerization reactor zone 160.

The second oligomerization stream may comprise $C_6$-$C_{11}$ olefins and preferably $C_7$-$C_9$ olefins and most preferably $C_8$ olefins that can dimerize in the second oligomerization reactor zone 160 to diesel range material comprising $C_{12}$-$C_{22}$ diesel product. The second oligomerization stream from the gasoline overhead line 242 is not recycled to be part of the first oligomerization feed stream to the first oligomerization reactor zone 140 via the first oligomerization feed conduit 132, but bypasses the first oligomerization reactor zone 140 and only enters the second oligomerization reactor zone 160 in the combined second oligomerization feed conduit 248. Accordingly, the gasoline overhead line 242 is out of upstream communication with the first oligomerization reactor zone 140 and is only in upstream communication with the second oligomerization reactor zone 160.

The second oligomerization feed stream in the second oligomerization feed line 246 feeds an oligomerization feed stream to the second oligomerization reactor zone 160 which may be in downstream communication with the oligomerization recovery zone 200. The second oligomerization reactor zone 160 is in downstream communication with the distillate separator column 240 and the second oligomerization feed line 246 via the combined second oligomerization feed conduit 248.

In an embodiment, the heavy oligomerate stream in a diesel bottom line 244 may be recycled to the first oligomerization reactor zone 140 in a recycle diesel line 260 in downstream communication with the oligomerization recovery zone 200 to be further oligomerized to heavier diesel product in the oligomerization zone 130 or to absorb the exotherm and facilitate maintenance of a liquid phase reaction. A recycle heavy oligomerate stream in recycle diesel line 260 taken from the diesel bottom stream in line 244 may be forwarded to the first reactor zone 140 as a separate stream in a separate line or as part of the first oligomerization feed stream in first oligomerization feed conduit 132. The heavy oligomerate stream from diesel bottom line 244 is not recycled to become part of the second oligomerization feed stream in the combined second oligomerization feed conduit 248 to the second oligomerization reactor zone 160 but bypasses the second oligomerization reactor zone 160 and only enters the first oligomerization reactor zone 140 in the first oligomerization feed conduit 132 via recycle diesel line 260. A control valve 260' may be used to completely shut off flow through recycle diesel line 260 or allow partial or full flow therethrough. In this embodiment, the first reactor zone 140 is in downstream communication with the distillate separator column 240 and particularly the diesel bottom line 244. The recycle diesel stream to the first reactor zone 140 may comprise no more than about 1 wt % $C_8$-olefins. The first oligomerization reactor zone 140 may be in downstream communication with the oligomerization recovery zone 200. The first oligomerization reactor zone 140 is in downstream communication with the diesel separator column 240 and the diesel recycle line 260.

Optionally, the recycle diesel stream may be saturated prior to recycle to the first oligomerization reactor zone 140 to prevent further oligomerization of diesel range olefins if smaller diesel molecules are desired, if light olefins in the first oligomerization feed stream are to be reserved for oligomerizing with other light olefins in the first reactor zone 140 or to avoid back cracking of distillate range olefins into the gasoline range.

In an aspect, the heavy oligomerate stream may be recovered as product in a diesel product line 262 in downstream communication with the oligomerization recovery zone 200. The diesel product stream in the diesel product line 262 is taken from the heavy oligomerate stream in diesel bottom line 244. A control valve 262' may be used to completely shut off flow through the diesel product line 262 or allow partial or full flow therethrough. The diesel product stream may be subjected to further processing to recover useful components or blended in the diesel pool. The diesel product line 262 may be in upstream communication with a diesel tank 264 or a diesel blending line of a diesel pool. Additionally, LCO from LCO line 107 may also be blended with diesel in diesel product line 262.

The second reactor zone 160 comprises an oligomerization reactor 162. The oligomerization reactor 162 contains a second oligomerization catalyst which may be different than the first oligomerization catalyst. The second oligomerate feed stream may be preheated before entering the oligomerization reactor 162 in the second reactor zone 160. The oligomerization reactor 162 may contain a first catalyst bed 164 of the second oligomerization catalyst. The oligomerization reactor 162 may be an upflow reactor to provide a uniform feed front through the catalyst bed, but other flow arrangements are contemplated. In an aspect, the oligomerization reactor 162 may contain an additional bed or beds 166 of the second oligomerization catalyst. $C_6$-$C_{11}$ olefins in the second oligomerization feed stream oligomerize with each other or with $C_4$ and $C_5$ olefins in the first oligomerization feed bypass stream from bypass line 170 over the second oligomerization catalyst to provide a second oligomerate stream, a heavy stream comprising diesel range materials.

Effluent from the first bed 164 may optionally be quenched with a liquid such as recycle oligomerate stream from the recycled oligomerate line 246 or the first oligomerization feed bypass stream in bypass line 170 before entering the additional bed 166 to avoid excessive temperature rise. The second oligomerization reactor zone 160 may include additional reactors and additional beds of second oligomerization catalyst.

A second oligomerate conduit 168, in downstream communication with the second oligomerization reactor zone 160, withdraws a second oligomerate stream from the second oligomerization reactor zone 160. The second oligomerate conduit 168 may be in downstream communication with the first oligomerization reactor 162. The first oligomerate stream and the second oligomerate stream may be transported together in the combined oligomerate conduit 180 to the oligomerization recovery zone 200. The first oligomerate stream and the second oligomerate stream may be separated together in the oligomerate recovery zone 200.

The reaction conditions in the oligomerization reactor 162 in the second oligomerization reactor zone 160 are set to keep the reactant fluids in the liquid phase. Operating pressures include between about 2.1 MPa (300 psia) and about 10.5 MPa (1520 psia), suitably at a pressure between about 2.1 MPa (300 psia) and about 6.9 MPa (1000 psia) and preferably at a pressure between about 2.8 MPa (400 psia) and about 4.1 MPa (600 psia). Lower pressures may be suitable if the reaction is kept in the liquid phase. The first oligomerization reactor zone 140 and the second oligomerization reactor zone 160 may be maintained at nearly the same pressure.

The temperature of the first oligomerization reactor zone 140 expressed in terms of a maximum bed temperature is in a range between about 150° C. and about 300° C. The maximum bed temperature should between about 200° C. and about 250° C. and preferably between about 215° and about 245° C. or between about 220° and about 240° C. to maximize diesel production. The weight hourly space velocity should be between about 0.5 and about 5 $hr^{-1}$.

The second reactor zone 160 may comprise a second oligomerization catalyst that is different from the first oligomerization catalyst. The second oligomerization catalyst may comprise a zeolitic catalyst. The zeolite may comprise between 5 and 95 wt % of the catalyst. Suitable zeolites include zeolites having a structure from one of the following classes: MFI, MEL, SFV, SVR, ITH, IMF, TUN, FER, EUO, BEA, FAU, BPH, MEI, MSE, MWW, UZM-8, MOR, OFF, MTW, TON, MTT, AFO, ATO, and AEL. These three letter codes for structure types are assigned and maintained by the International Zeolite Association Structure Commission in the ATLAS OF ZEOLITE FRAMEWORK TYPES, which is at http://www.iza-structure.org/databases/. In a preferred aspect, the oligomerization catalyst may comprise a zeolite with a framework having a ten-ring pore structure. Examples of suitable zeolites having a ten-ring pore structure include those comprising TON, MTT, MFI, MEL, AFO, AEL, EUO and FER. In a further preferred aspect, the oligomerization catalyst comprising a zeolite having a ten-ring pore structure may comprise a uni-dimensional pore structure. A uni-dimensional pore structure indicates zeolites containing non-intersecting pores that are substantially parallel to one of the axes of the crystal. The pores preferably extend through the zeolite crystal. Suitable examples of zeolites having a ten-ring uni-dimensional pore structure may include MTT. In a further aspect, the oligomerization catalyst comprises an MTT zeolite.

The oligomerization catalyst may be formed by combining the zeolite with a binder, and then forming the catalyst into pellets. The pellets may optionally be treated with a phosphoric reagent to create a zeolite having a phosphorous component between 0.5 and 15 wt % of the treated catalyst. The binder is used to confer hardness and strength on the catalyst. Binders include alumina, aluminum phosphate, silica, silica-alumina, zirconia, titania and combinations of these metal oxides, and other refractory oxides, and clays such as montmorillonite, kaolin, palygorskite, smectite and attapulgite. A preferred binder is an aluminum-based binder, such as alumina, aluminum phosphate, silica-alumina and clays.

One of the components of the catalyst binder utilized in the present invention is alumina. The alumina source may be any of the various hydrous aluminum oxides or alumina gels such as alpha-alumina monohydrate of the boehmite or pseudo-boehmite structure, alpha-alumina trihydrate of the gibbsite structure, beta-alumina trihydrate of the bayerite structure, and the like. A suitable alumina is available from UOP LLC under the trademark Versal. A preferred alumina is available from Sasol North America Alumina Product Group under the trademark Catapal. This material is an extremely high purity alpha-alumina monohydrate (pseudo-boehmite) which after calcination at a high temperature has been shown to yield a high purity gamma-alumina.

A suitable oligomerization catalyst is prepared by mixing proportionate volumes of zeolite and alumina to achieve the desired zeolite-to-alumina ratio. In an embodiment, about 5 to about 80, typically about 10 to about 60, suitably about 15 to about 40 and preferably about 20 to about 30 wt % MTT zeolite and the balance alumina powder will provide a suitably supported catalyst. A silica support is also contemplated.

Monoprotic acid such as nitric acid or formic acid may be added to the mixture in aqueous solution to peptize the alumina in the binder. Additional water may be added to the mixture to provide sufficient wetness to constitute a dough with sufficient consistency to be extruded or spray dried. Extrusion aids such as cellulose ether powders can also be added. A preferred extrusion aid is available from The Dow Chemical Company under the trademark Methocel.

The paste or dough may be prepared in the form of shaped particulates, with the preferred method being to extrude the dough through a die having openings therein of desired size and shape, after which the extruded matter is broken into extrudates of desired length and dried. A further step of calcination may be employed to give added strength to the extrudate. Generally, calcination is conducted in a stream of air at a temperature from about 260° C. (500° F.) to about 815° C. (1500° F.). The MTT catalyst is not selectivated to neutralize surface acid sites such as with an amine. The extruded particles may have any suitable cross-sectional shape.

The oligomerization catalyst, and particularly, the uni-dimensional, 10-ring pore structured zeolite, converts a significant fraction of the gasoline-range olefins, such as $C_6$ to $C_{11}$ and preferably $C_8$ olefins, to distillate material by oligomerizing them with other gasoline-range olefins. When gasoline is fed from the gasoline overhead line 242 to the second oligomerization reactor zone 160 for oligomerization over a the second oligomerization catalyst, the second oligomerate stream from the oligomerization zone in the second oligomerate conduit 168 may comprise greater than 30 wt % $C_9$+ olefins. The second oligomerization catalyst has an ability to dimerize or co-oligomerize the gasoline range olefins to heavier diesel range olefins. Under these circumstances, the second oligomerate stream from the second oligomerization reactor zone in the second oligomerate conduit 168 may comprise greater than 50 wt % or even greater than 60 wt % $C_9$+ olefins.

The invention will now be further illustrated by the following non-limiting examples.

EXAMPLES

Example 1

Feed 1 in Table 1 was contacted with four catalysts to determine their effectiveness in oligomerizing butenes.

TABLE 1

| Component | Fraction, wt % |
|---|---|
| Propylene | 0.1 |
| Iso-$C_4$'s | 70.04 |
| Isobutylene | 7.7 |
| 1-butene | 5.7 |
| 2-butene (cis and trans) | 16.28 |
| 3-methyl-1-butene | 0.16 |
| acetone | 0.02 |
| Total | 100 |

Catalyst A is an MTT catalyst purchased from Zeolyst having a product code Z2K019E and extruded with alumina to be 25 wt % zeolite. Of MTT zeolite powder, 53.7 grams was combined with 2.0 grams Methocel and 208.3 grams Catapal B boehmite. These powders were mixed in a muller before a mixture of 18.2 g $HNO_3$ and 133 grams distilled water was added to the powders. The composition was blended thoroughly in the muller to effect an extrudable dough of about 52% LOI. The dough then was extruded through a die plate to form cylindrical extrudates having a diameter of about 3.18 mm. The extrudates then were air dried, and calcined at a temperature of about 550° C. The MTT catalyst was not selectivated to neutralize acid sites such as with an amine.

Catalyst B is a SPA catalyst commercially available from UOP LLC.

Catalyst C is an MTW catalyst with a silica-to-alumina ratio of 36:1. Of MTW zeolite powder made in accordance with the teaching of U.S. Pat. No. 7,525,008 B2, 26.4 grams was combined with and 135.1 grams Versal 251 boehmite. These powders were mixed in a muller before a mixture of 15.2 grams of nitric acid and 65 grams of distilled water were added to the powders. The composition was blended thoroughly in the muller to effect an extrudable dough of about 48% LOI. The dough then was extruded through a die plate to form cylindrical extrudates having a diameter of about 1/32". The extrudates then were air dried and calcined at a temperature of about 550° C.

Catalyst D is an MFI catalyst purchased from Zeolyst having a product code of CBV-8014 having a silica-to-alumina ratio of 80:1 and extruded with alumina at 25 wt % zeolite. Of MFI-80 zeolite powder, 53.8 grams was combined with 205.5 grams Catapal B boehmite and 2 grams of Methocel. These powders were mixed in a muller before a mixture of 12.1 grams nitric acid and 115.7 grams distilled water were added to the powders. The composition was blended thoroughly in the muller, then an additional 40 grams of water was added to effect an extrudable dough of about 53% LOI. The dough then was extruded through a die plate to form cylindrical extrudates having a diameter of about 3.18 mm. The extrudates then were air dried, and calcined at a temperature of about 550° C.

Figure 2:
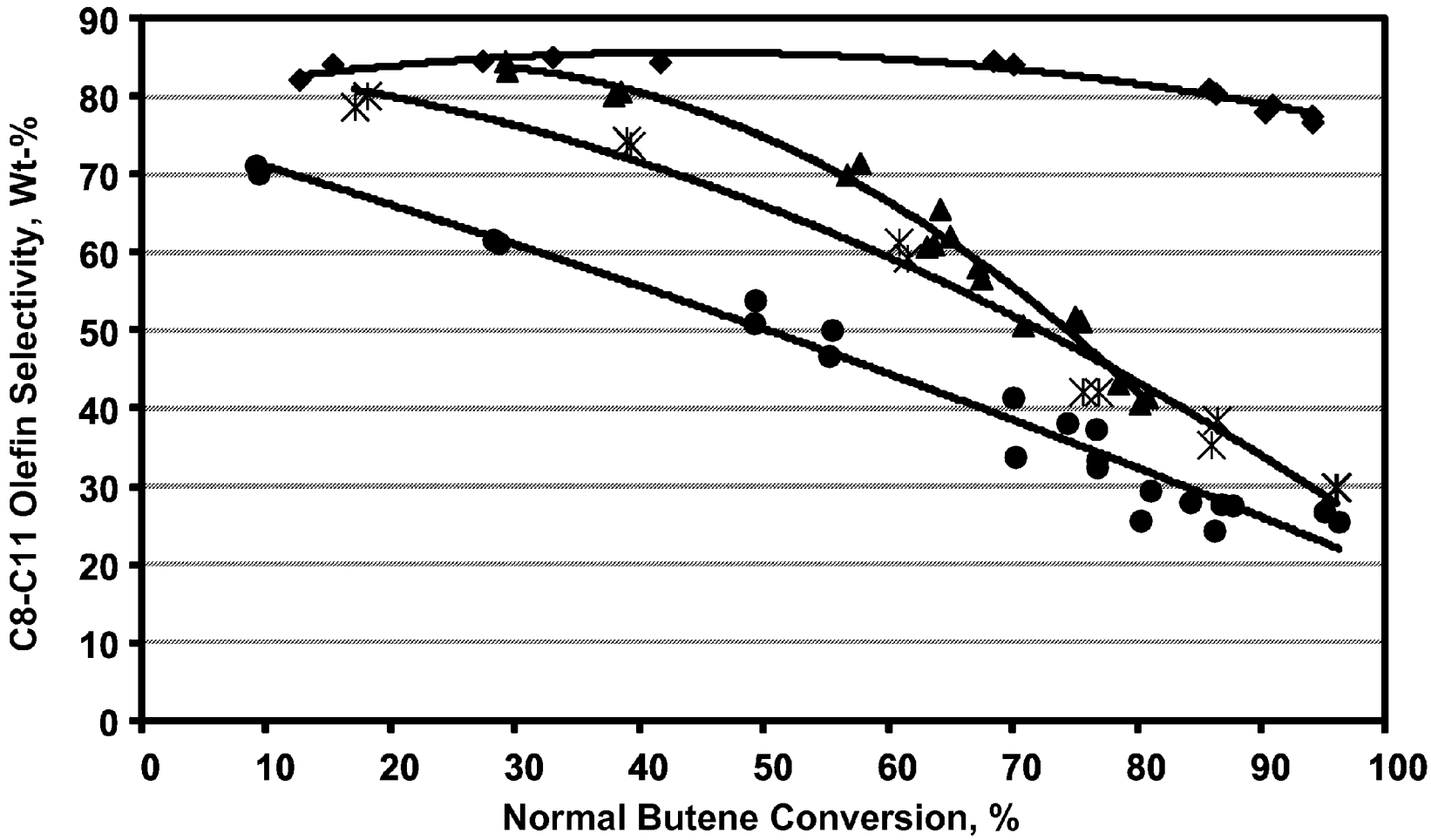
FIG. 2 is a plot of $C_8$-$C_{11}$ olefin selectivity versus normal butene conversion.
Figure 3:
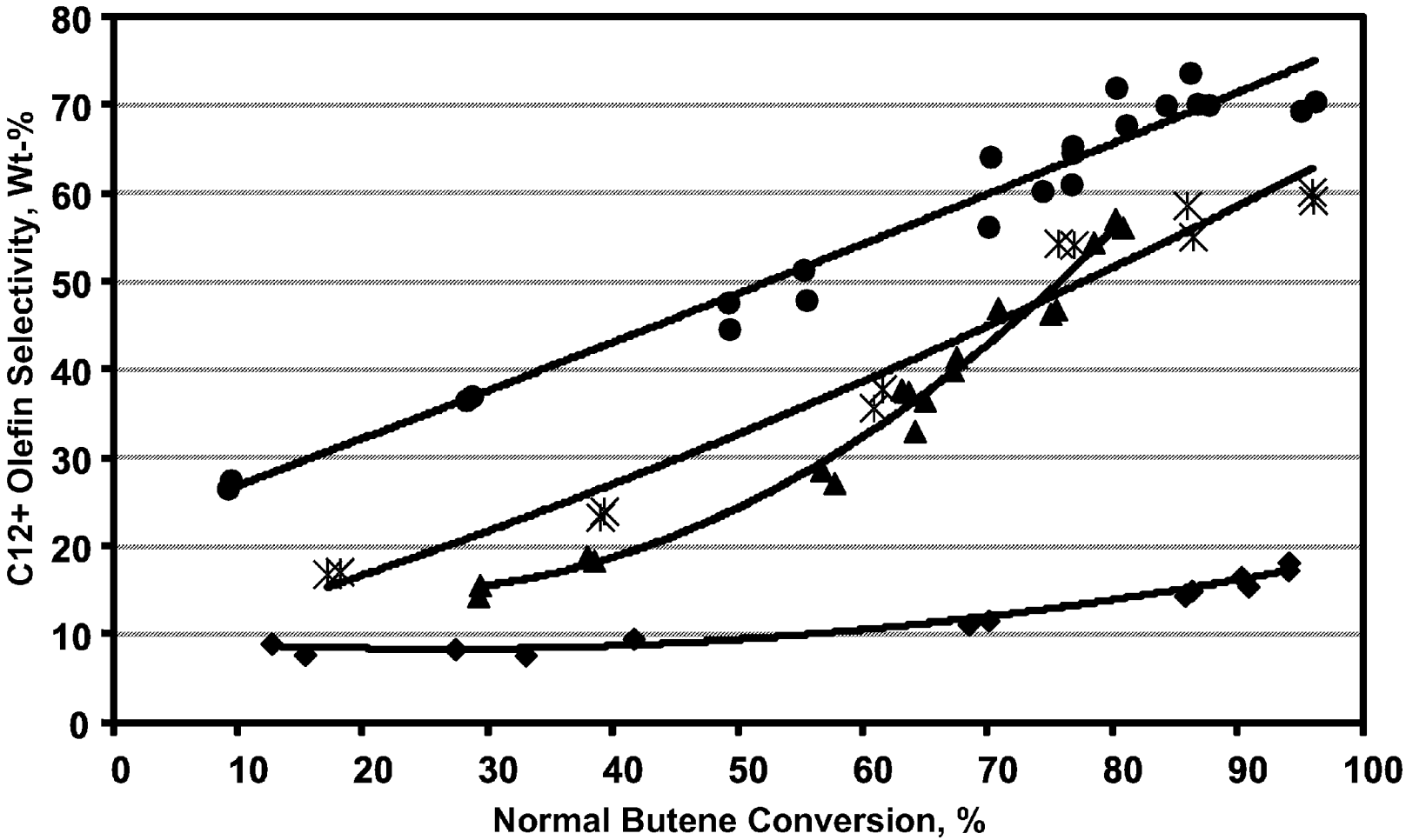
FIG. 3 is a plot of $C_{12}$+ olefin selectivity versus normal butene conversion.

The experiments were operated at 6.2 MPa and inlet temperatures at intervals between 160° and 240° C. to obtain different normal butene conversions. Results are shown in FIGS. 2 and 3. In FIG. 2, $C_8$ to $C_{11}$ olefin selectivity is plotted against normal butene conversion to provide profiles for each catalyst.

Table 2 compares the RONC±3 for each product by catalyst and provides a key to FIG. 2. The RONC was determined for the composite product for each catalyst run per ASTM D2699. The SPA catalyst B is superior for selectivity to gasoline-range olefins. The MTT catalyst A is the least effective in producing gasoline range olefins.

TABLE 2

| Catalyst | | | RONC |
|---|---|---|---|
| A | MTT | circles | 92 |
| B | SPA | diamonds | 96 |
| C | MTW | triangles | 97 |
| D | MFI-80 | asterisks | 95 |

The SPA catalyst was able to achieve over 95 wt % yield of gasoline having a RONC of >95 and with an Engler T90 value of 185° C. for the entire product. The T-90 gasoline specification is less than 193° C.

In FIG. 3, $C_{12}$+ olefin selectivity is plotted against normal butene conversion to provide profiles for each catalyst. Table 3 compares the derived cetane number±2 for each product by catalyst and provides a key to FIG. 3. The cetane number was determined for the composite product for each catalyst run per ASTM D6890.

TABLE 3

| Catalyst | | | Cetane |
|---|---|---|---|
| A | MTT | circles | 41 |
| B | SPA | diamonds | <14 |
| C | MTW | triangles | 28 |
| D | MFI-80 | asterisks | 36 |

FIG. 3 shows that the MTT catalyst provides the highest $C_{12}$+ olefin selectivity which reaches over 70 wt %. These selectivities are from a single pass of the feed stream through the oligomerization reactor. Additionally, the MTT catalyst provided $C_{12}$+ oligomerate with the highest derived cetane. Cetane was derived using ASTM D6890 on the $C_{12}$+ fraction at the 204° C. (400° F.) cut point. Conversely to gasoline selectivity, the MTT catalyst A is superior in producing diesel range olefins, and the SPA catalyst B is the least effective in producing diesel range olefins.

The MTT catalyst was able to produce diesel with a cetane rating of greater than 40. The diesel cloud point was determined by ASTM D2500 to be −66° C. and the T90 was 319° C. using ASTM D86 Method. The T90 specification for diesel in the United States is between 282 and 338° C., so the diesel product meets the U.S. diesel standard.

Example 2

Two types of feed were oligomerized over oligomerization catalyst A of Example 1, MTT zeolite. Feeds 1 and 2 contacted with catalyst A are shown in Table 4. Feed 1 is from Example 1.

TABLE 4

| Component | Feed 1 Fraction, wt % | Feed 2 Fraction, wt % |
|---|---|---|
| propylene | 0.1 | 0.1 |
| isobutane | 70.04 | 9.73 |
| isobutylene | 7.7 | 6.3 |
| 1-butene | 5.7 | 4.9 |
| 2-methyl-2-butene | 0 | 9.0 |
| 2-butene (cis & trans) | 16.28 | 9.8 |
| 3-met-1-butene | 0.16 | 0.16 |
| n-hexane | 0 | 60 |
| acetone | 0.02 | 0.01 |
| Total | 100 | 100 |

In Feed 2, $C_5$ olefin is made up of 2-methyl-2-butene and 3-methyl-1-butene which comprises 9.16 wt % of the reaction mixture representing about a third of the olefins in the feed. 3-methyl-1-butene is present in both feeds in small amounts. Propylene was present at less than 0.1 wt % in both feeds.

The reaction conditions were 6.2 MPa and a 1.5 WHSV. The maximum catalyst bed temperature was 220° C. Oligomerization achievements are shown in Table 5.

TABLE 5

| | Feed 1 | Feed 2 |
|---|---|---|
| Inlet Temperature, ° C. | 192 | 198 |
| $C_4$ olefin conversion, % | 98 | 99 |
| $nC_4$ olefin conversion, % | 97 | 99 |
| $C_5$ olefin conversion, % | n/a | 95 |
| $C_5$-$C_7$ selectivity, wt % | 3 | 5 |
| $C_8$-$C_{11}$ selectivity, wt % | 26 | 40 |
| $C_{12}$-$C_{15}$ selectivity, wt % | 48 | 40 |

TABLE 5-continued

| | Feed 1 | Feed 2 |
|---|---|---|
| $C_{16}$+ selectivity, wt % | 23 | 16 |
| Total $C_9$+ selectivity, wt % | 78 | 79 |
| Total $C_{12}$+ selectivity, wt % | 71 | 56 |
| Net gasoline yield, wt % | 35 | 44 |
| Net distillate yield, wt % | 76 | 77 |

Normal $C_4$ olefin conversion reached 99% with $C_5$ olefins in Feed 2 and was 97 wt % without $C_5$ olefins in Feed 1. $C_5$ olefin conversion reached 95%. Feed 2 with $C_5$ olefins oligomerized to a greater selectivity of lighter, gasoline range product in the $C_5$-$C_7$ and $C_8$-$C_{11}$ range and a smaller selectivity to heavier distillate range product in the $C_{12}$-$C_{15}$ and $C_{16}$+ range.

By adding $C_5$ olefins to the feed, a greater yield of gasoline can be made over Catalyst A, MTT. A greater net yield of gasoline and a lower selectivity to $C_{12}$+ fraction was achieved for Feed 2 than for Feed 1. Also, but not to the same degree, by adding $C_5$ olefins to the feed a greater yield of distillate range material can be made. This is confirmed by the greater net yield of distillate for Feed 2 than for Feed 1 on a single pass basis. Gasoline yield was classified by product meeting the Engler T90 requirement and distillate yield was classified by product boiling over 150° C. (300° F.).

Example 3

Three types of feed were oligomerized over oligomerization catalyst B of Example 1, SPA. The feeds contacted with catalyst B are shown in Table 6. Feed 2 is the same as Feed 2 in Example 2. Normal hexane and isooctane were used as a heavy paraffin solvents with Feeds 2 and 3, respectively. All feeds had similar $C_4$ olefin levels and $C_4$ olefin species distributions. Feed 4 is similar to Feed 2 but has the pentenes evenly split between iso- and normal pentenes, which is roughly expected to be found in an FCC product, and Feed 4 was diluted with isobutane instead of n-hexane.

TABLE 6

| Component | Feed 2 Fraction, wt % | Feed 3 Fraction, wt % | Feed 4 Fraction, wt % |
|---|---|---|---|
| propylene | 0.1 | 0.08 | 0.1 |
| 1,3-butadiene | 0 | 0.28 | 0 |
| isobutane | 9.73 | 6.45 | 69.72 |
| isobutylene | 6.3 | 7.30 | 6.3 |
| 1-butene | 4.9 | 5.07 | 4.9 |
| 2-methyl-2-butene | 9.0 | 0 | 4.5 |
| 2-butene (cis & trans) | 9.8 | 11.33 | 9.8 |
| 3-met-1-butene | 0.16 | 0.16 | 0.16 |
| 2-pentene | 0 | 0 | 4.5 |
| cyclopentane | 0 | 0.28 | 0 |
| n-hexane | 60 | 0 | 0 |
| isooctane | 0 | 60.01 | 0 |
| acetone | 0.01 | 0.01 | 0.02 |
| Total | 100 | 100 | 100 |

The reaction pressure was 3.5 MPa. Oligomerization process conditions and testing results are shown in Table 7.

TABLE 7

| | Feed 2 | Feed 3 | Feed 4 |
|---|---|---|---|
| WHSV, $hr^{-1}$ | .75 | 1.5 | .75 |
| Pressure, MPa | 3.5 | 3.5 | 6.2 |
| Inlet Temperature, ° C. | 190 | 170 | 178 |

TABLE 7-continued

| | Feed 2 | Feed 3 | Feed 4 |
|---|---|---|---|
| Maximum Temperature, ° C. | 198 | 192 | 198 |
| Total $C_4$ olefin conversion, % | 95 | 92 | 93 |
| n-butene conversion, % | 95 | 90 | 93 |
| Total $C_5$ olefin conversion, % | 90 | n/a | 86 |
| $C_5$-$C_7$ selectivity, wt % | 8 | 5 | 8 |
| $C_8$-$C_{11}$ selectivity, wt % | 77 | 79 | 77 |
| $C_{12}$-$C_{15}$ selectivity, wt % | 15 | 16 | 15 |
| $C_{16}$+ selectivity, wt % | 0.3 | 0.1 | .01 |
| Total $C_9$+ selectivity, wt % | 35 | 20 | 25 |
| Total $C_{12}$+ selectivity, wt % | 17 | 16 | 15 |
| Net gasoline yield, wt % | 94 | 92 | 91 |
| Net distillate yield, wt % | 32 | 18 | 23 |
| RONC (±3) | 97 | 96 | 96 |
| Engler T-90, ° C. | 182 | 164 | 182 |

Net gasoline yield goes up to $C_{12}$-hydrocarbons and net distillate yield goes down to $C_9$+ hydrocarbons to account for different cut points that may be selected by a refiner. Olefin conversion was at least 90% and normal butene conversion was over 90%. Normal butene conversion reached 95% with $C_5$ olefins in Feed 2 and was 90% without $C_5$ olefins in Feed 3. $C_5$ olefin conversion reached 90% but was less when both iso- and normal $C_5$ olefins were in Feed 4.

It can be seen that the SPA catalyst minimized the formation of $C_{12}$+ species to below 20 wt %, specifically, at 16 and 17 wt %, respectively, for feeds containing $C_4$ olefins or mixtures of $C_4$ and $C_5$ olefins in the oligomerization feed stream. When normal $C_5$ olefins were added, $C_{12}$+ formation reduced to 15 wt %. The $C_6$+ oligomerate produced by all three feeds met the gasoline T-90 spec indicating that 90 wt % boiled at temperatures under 193° C. (380° F.). The Research Octane Number for all three products was high, over 95, with and without substantial $C_5$ olefins present.

Example 4

Feed 2 with $C_5$ olefins present was subjected to oligomerization with Catalyst B, SPA, at different conditions to obtain different butene conversions. $C_5$ olefin is made up of 2-methyl-2-butene and 3-methyl-1-buene which comprises 9.16 wt % of the reaction mixture representing about a third of the olefins in the feed. Propylene was present at less than 0.1 wt %. Table 8 shows the legend of component olefins illustrated in FIG. 4.

TABLE 8

Figure 4:
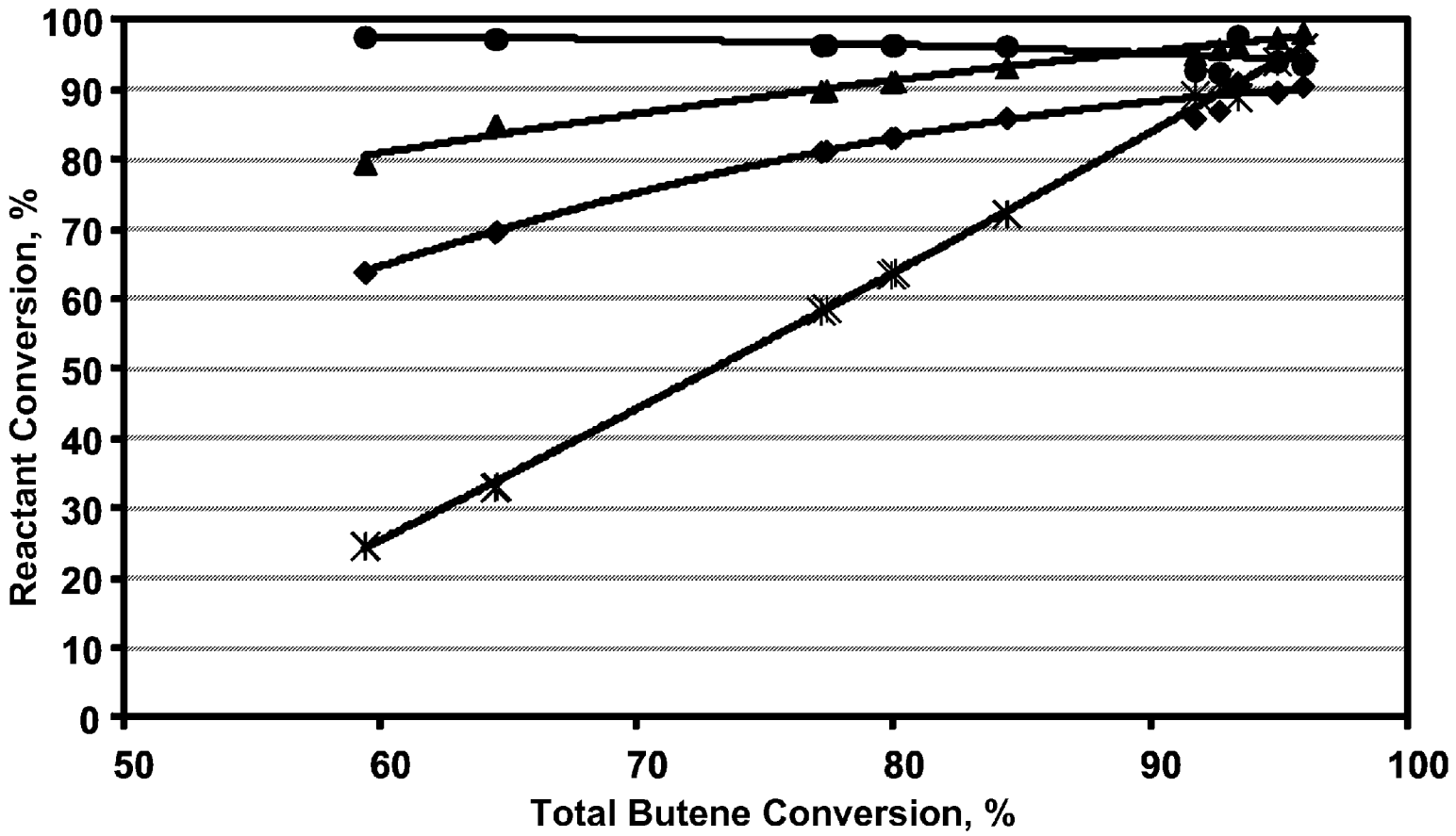
FIG. 4 is a plot of reactant conversion versus total butene conversion.

| Component | Symbols in FIG. 4 |
|---|---|
| isobutylene | Circle |
| 1-butene | Triangle |
| 2-methyl-2-butene and 3-met-1-butene | Diamond |
| 2-butene (cis & trans) | Asterisk |

FIG. 4 shows conversions for each of the olefins in Feed 2 over Catalyst B, SPA. Over 95% conversion of normal $C_4$ olefins was achieved at over 90% total butene conversion. Pentene conversion reached 90% at over 90% total butene conversion. Normal butene conversion actually exceeded isobutene conversion at high butene conversion over about 95%.

Example 5

Three feeds were oligomerized to demonstrate the ability of Catalyst A, MTT, to produce diesel range oligomerate by recycling gasoline range oligomerate to the oligomerization zone. Feed 1 from Example 1 with an isobutane diluent was tested along with Feed 5 which had a normal hexane diluent and Feed 6 which had an isobutane diluent but spiked with diisobutene to simulate the recycle of gasoline range oligomers to the reactor feed. The feeds are shown in Table 9. The symbols in FIG. 5 correspond to those indicated in the last row of Table 9.

TABLE 9

Figure 5:
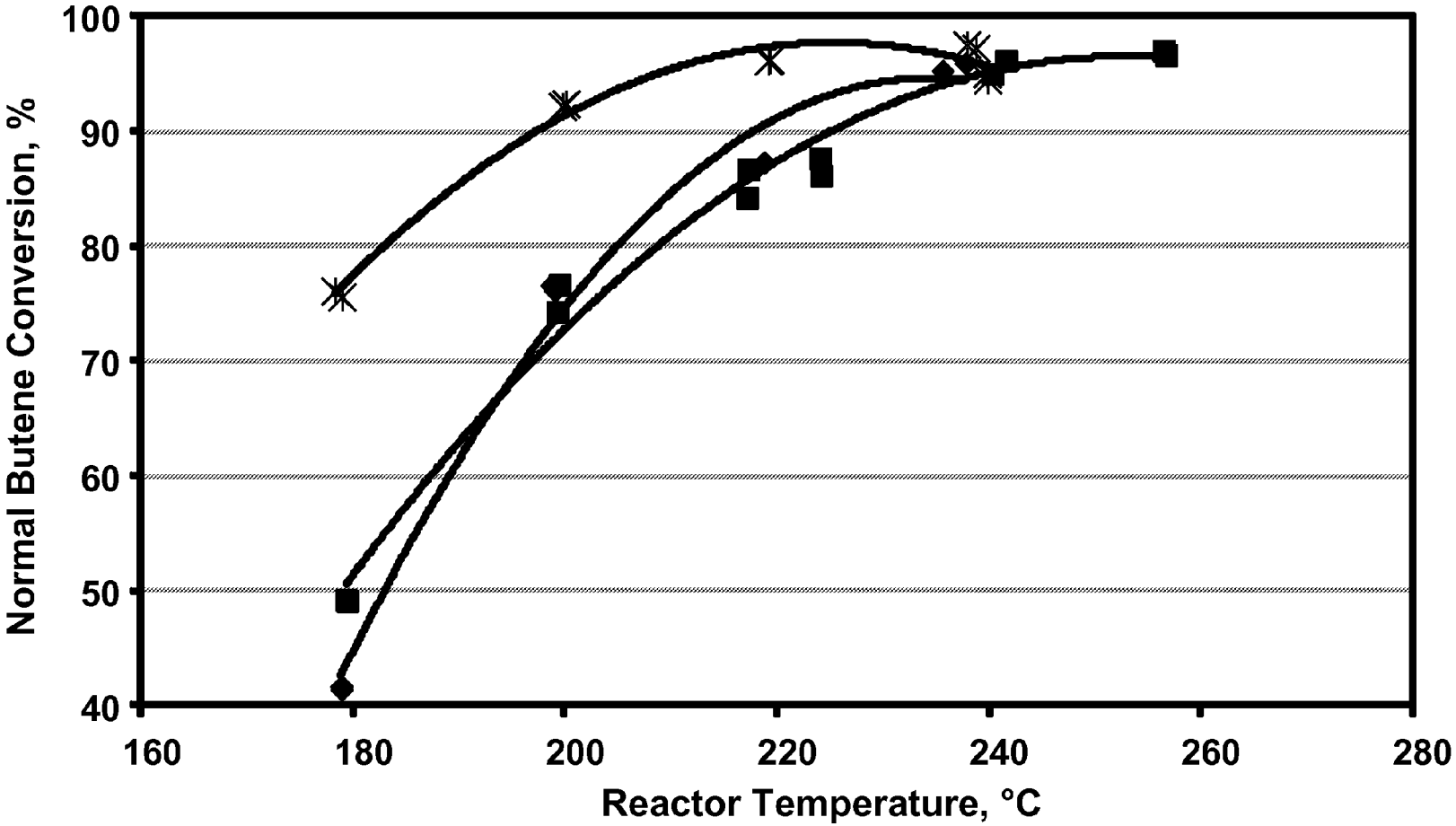
FIG. 5 is a plot of normal butene conversion versus reactor temperature.

| Component | Feed 1 Fraction, wt % | Feed 5 Fraction, wt % | Feed 6 Fraction, wt % |
|---|---|---|---|
| propylene | 0.1 | 0.08 | 0.08 |
| isobutane | 70.04 | 15.75 | 15.75 |
| isobutylene | 7.7 | 7.3 | 7.3 |
| 1-butene | 5.7 | 5.1 | 5.1 |
| 2-butene (cis & trans) | 16.28 | 11.6 | 11.6 |
| 3-met-1-butene | 0.16 | 0.16 | 0.16 |
| n-hexane | 0 | 60 | 0 |
| acetone | 0.02 | 0.01 | 0.01 |
| tert-butyl alcohol | 0 | 0.0008 | 0.0008 |
| diisobutene | 0 | 0 | 60 |
| Total | 100 | 100 | 100 |
| FIG. 5 symbol | square | diamond | asterisk |

The oligomerization conditions included 6.2 MPa pressure, 0.75 WHSV over Catalyst A, MTT. Normal butene conversion as a function of temperature is graphed in FIG. 5 for the three feeds.

Figure 6:
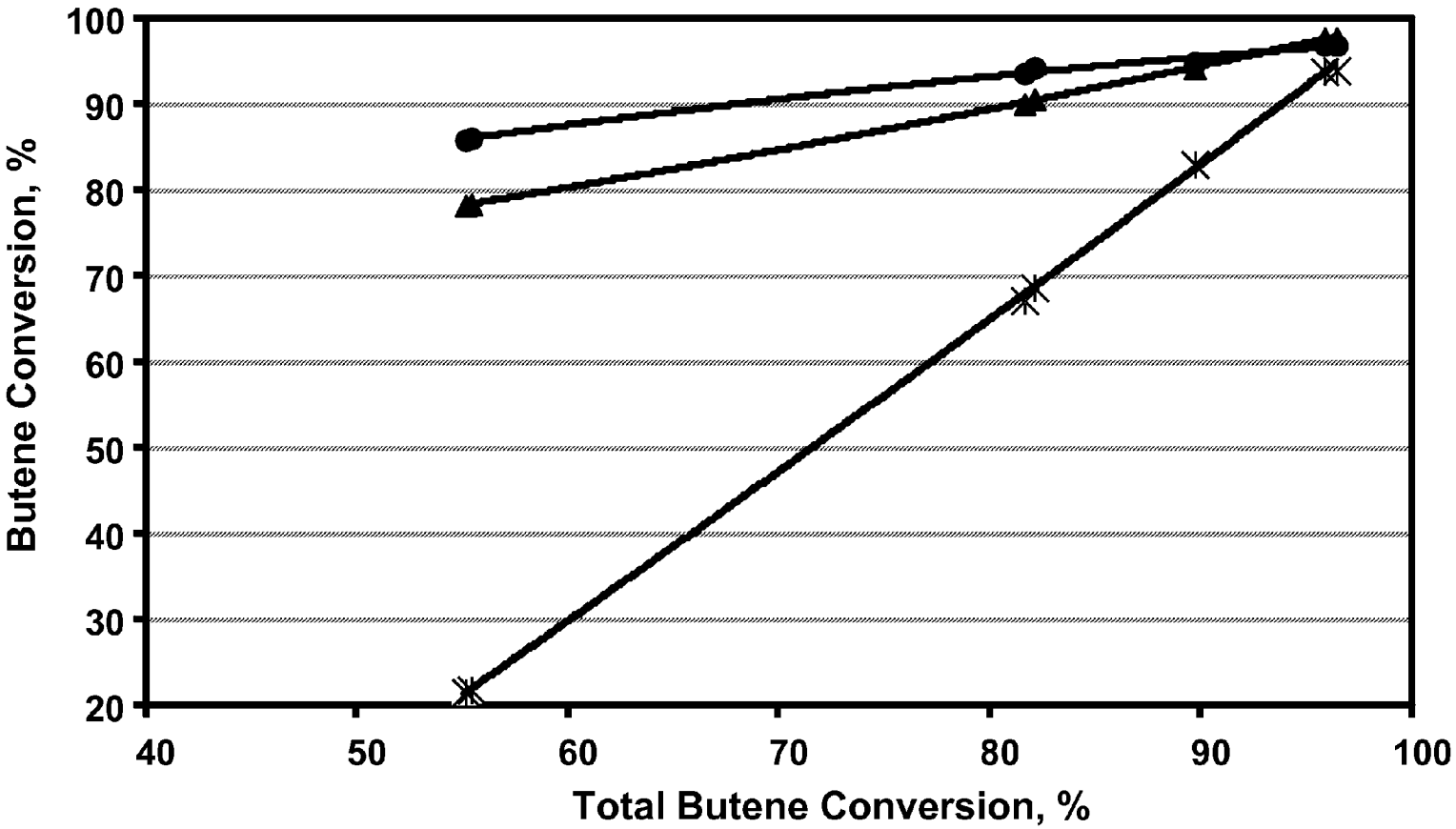
FIGS. 6 and 7 are plots of butene conversion versus total butene conversion.
Figure 7:
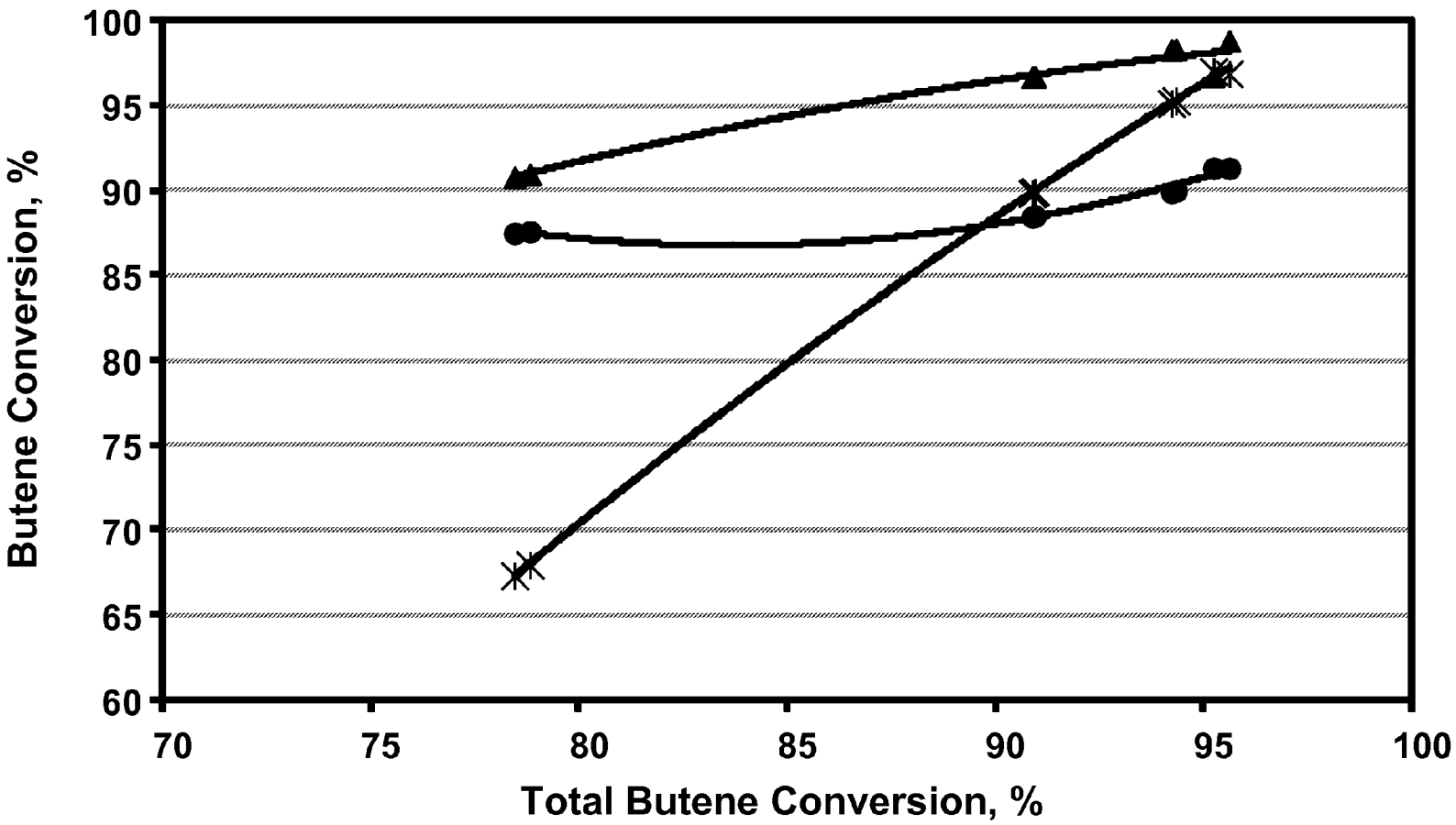

FIG. 5 demonstrates that Feed 6 with the diisobutene oligomer has greater normal butene conversion at equivalent temperatures between 180° and 240° C. Consequently, gasoline oligomerate recycle to the oligomerization zone will improve normal butene conversion. Butene conversion for Feed 5 is shown in FIG. 6 and for Feed 6 is shown in FIG. 7. The key for FIGS. 6 and 7 is shown in Table 10.

TABLE 10

| Component | Symbols in FIGS. 6 & 7 |
|---|---|
| isobutylene | Circle |
| 1-butene | Triangle |
| 2-butene (cis & trans) | Asterisk |

At higher butene conversions and with diisobutene recycle, isobutene has the lowest conversion with both 1-butene and 2-butene having greater oligomerization to oligomers. This result is probably due to back-cracking of diisobutene back to isobutene. However, without diisobutene recycle, isobutene undergoes the greatest conversion, but with 1-butene conversion apparently surpassing isobutene conversion at over 94% total butene conversion. This trend may be showing that isobutene is more reactive and reaches a back-cracking limit faster, after which isobutene conversion is limited. We expect the same performance for Feed 1 with isobutane diluent.

Table 11 gives feed performance for the three feeds at conditions selected to achieve high butene conversion and high $C_{12}$+ yield including 6.2 MPa of pressure.

TABLE 11

| Run | Feed 1 | Feed 5 | Feed 6 |
|---|---|---|---|
| WHSV, $hr^{-1}$ | 0.9 | 0.6 | 0.7 |
| Maximum Bed Temperature, ° C. | 240 | 236 | 239 |
| Total $C_4$ olefin conversion, % | 95 | 96 | 95 |

TABLE 11-continued

| Run | Feed 1 | Feed 5 | Feed 6 |
|---|---|---|---|
| n-butene conversion, % | 95 | 95 | 97 |
| isobutene conversion, % | 96 | 97 | 91 |
| 1-butene conversion, % | 97 | 98 | 97 |
| 2-butene conversion, % | 94 | 94 | 97 |
| $C_5$-$C_7$ selectivity, wt % | 3 | 3 | 0.8 |
| $C_8$-$C_{11}$ selectivity, wt % | 27 | 27 | 26 |
| $C_{12}$-$C_{15}$ selectivity, wt % | 49 | 52 | 39 |
| $C_{16}$+ selectivity, wt % | 20 | 19 | 34 |
| Total $C_9$+ selectivity, wt % | 76 | 77 | 77 |
| Total $C_{12}$+ selectivity, wt % | 70 | 71 | 73 |
| Diesel Yield, wt % | 72 | 74 | 73 |

$C_{12}$+ selectivity increased and $C_{16}$+ selectivity increased substantially with feeds containing diisobutene compared with feeds without diisobutene. Yield calculated by multiplying $C_4$ olefin conversion by total $C_9$+ selectivity taken at the 150° C. (300° F.) cut point was over 70% for all feeds based on a single pass through the oligomerization reactor.

Example 6

Figure 8:
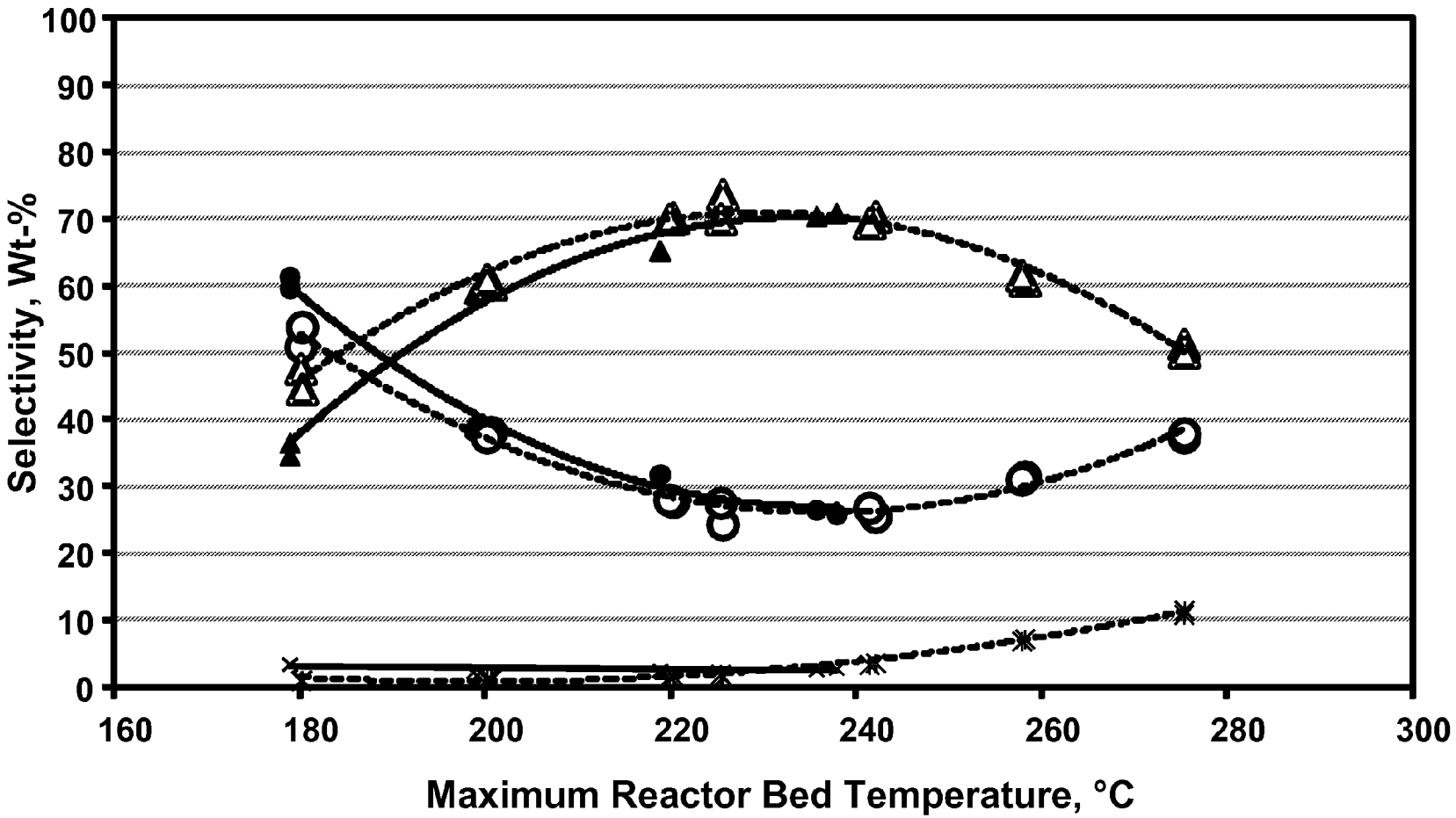
FIG. 8 is a plot of selectivity versus maximum reactor bed temperature.

Feed 1 and Feed 5 were reacted over Catalyst A, MTT, at 6.2 MPa and 0.75 WHSV. A graph of selectivity as a function of maximum catalyst bed temperature in FIG. 8 shows optimal maximum bed temperature between about 220° and about 240° C. has an apex that corresponds with maximal $C_{12}$+ olefin selectivity and to a minimum $C_8$-$C_{11}$ olefin selectivity and a $C_5$-$C_7$ olefin selectivity. Table 12 provides a key for FIG. 8. In FIG. 8, solid points and lines represent Feed 1; whereas; hollow points and dashed lines represent Feed 5.

TABLE 12

| Symbol | Solid - Feed 1 | Hollow - Feed 5 |
|---|---|---|
| $C_{12}$+ olefin selectivity | Triangles | |
| $C_8$-$C_{11}$ olefin selectivity | Circles | |
| $C_5$-$C_7$ olefin selectivity | Greek Crosses | Asterisks |

Example 7

Diisobutene feed was oligomerized over Catalyst A and Catalyst B of Example 1. The oligomerization conditions included a maximum reactor bed temperature of 210° C., a pressure of 3.5 kPa (gauge) (500 psig) and a WHSV of 0.6 $hr^{-1}$. Results are shown in Table 13.

TABLE 13

| Oligomerate Species | Yield Catalyst A, wt % | Yield Catalyst B, wt % |
|---|---|---|
| $C_4$ | 3 | 2 |
| $C_5$-$C_7$ | 1 | 3 |
| $C_8$-$C_{11}$ = | 36 | 52 |
| $C_{12}$-$C_{15}$ = | 42 | 42 |
| $C_{16}$ =+ | 19 | 1 |

It is evident from the results in Table 13 that MTT catalyst A is effective for increasing heavier distillate, particularly in the $C_{16}$+ range by oligomerization of gasoline range olefins in a second oligomerization reactor zone.

Specific Embodiments

While the following is described in conjunction with specific embodiments, it will be understood that this description is intended to illustrate and not limit the scope of the preceding description and the appended claims.

A first embodiment of the invention is a process for oligomerization comprising passing a first oligomerization feed stream comprising $C_4$ olefins to an oligomerization reactor zone comprising a first catalyst to oligomerize $C_4$ olefins in the oligomerization feed stream to produce a first oligomerate stream; separating the oligomerate stream from the oligomerization reactor zone in a recovery zone to provide a second oligomerization feed stream and a heavy stream; passing the second oligomerization feed stream to a second oligomerization reactor zone comprising a second catalyst different from the first catalyst to produce a second oligomerate stream. An embodiment of the invention is one, any or all of prior embodiments in this paragraph up through the first embodiment in this paragraph wherein the first catalyst is a SPA catalyst and the second catalyst is a zeolite catalyst. An embodiment of the invention is one, any or all of prior embodiments in this paragraph up through the first embodiment in this paragraph wherein the zeolite catalyst has a uni-dimensional 10-ring pore structure. An embodiment of the invention is one, any or all of prior embodiments in this paragraph up through the first embodiment in this paragraph wherein the separation step produces a gasoline stream as the second oligomerization feed stream that is oligomerized to produce the heavy stream comprising diesel. An embodiment of the invention is one, any or all of prior embodiments in this paragraph up through the first embodiment in this paragraph wherein the separation step separates a light stream comprising unreacted $C_4$ hydrocarbons from the first oligomerate stream. An embodiment of the invention is one, any or all of prior embodiments in this paragraph up through the first embodiment in this paragraph wherein the separation step separates an intermediate stream comprising unreacted $C_5$ hydrocarbons from the first oligomerate stream. An embodiment of the invention is one, any or all of prior embodiments in this paragraph up through the first embodiment in this paragraph wherein the separation step separates the first oligomerate stream to provide the second oligomerization feed stream comprising gasoline and the heavy stream. An embodiment of the invention is one, any or all of prior embodiments in this paragraph up through the first embodiment in this paragraph wherein the first oligomerate stream has the light stream separated from it before it is separated to provide the second oligomerization feed stream comprising gasoline and the heavy stream. An embodiment of the invention is one, any or all of prior embodiments in this paragraph up through the first embodiment in this paragraph wherein the heavy stream is recycled to be part of the first oligomerization feed stream. An embodiment of the invention is one, any or all of prior embodiments in this paragraph up through the first embodiment in this paragraph wherein the second oligomerization feed stream comprises no more than 15 wt % $C_{12}$ hydrocarbons.

A second embodiment of the invention is a process for oligomerization comprising passing a first oligomerization feed stream comprising $C_4$ olefins to an oligomerization zone comprising SPA catalyst to oligomerize $C_4$ olefins in the oligomerization feed stream to produce a first oligomerate stream; separating the oligomerate stream from the oligomerization zone in a recovery zone to provide a second oligomerization feed stream and a heavy stream; passing the second oligomerization feed stream to a second oligomerization zone comprising a zeolite catalyst comprising a uni-dimensional 10-ring pore structure to produce a second oligomerate stream. An embodiment of the invention is one, any or all of prior embodiments in this paragraph up through the second embodiment in this paragraph wherein the zeolite catalyst is an MTT. An embodiment of the invention is one, any or all of prior embodiments in this paragraph up through the second embodiment in this paragraph wherein the separation step produces a gasoline stream as the second oligomerization feed stream that is oligomerized to produce the heavy stream comprising diesel.

A third embodiment of the invention is a process for oligomerization comprising passing a first oligomerization feed stream comprising $C_4$ olefins to an oligomerization zone comprising a first catalyst to oligomerize $C_4$ olefins in the oligomerization feed stream to produce a first oligomerate stream; separating the oligomerate stream from the oligomerization zone in a recovery zone to provide a second oligomerization feed stream and a heavy stream; passing the second oligomerization feed stream to a second oligomerization zone comprising a second catalyst that is different from the first catalyst to produce a second oligomerate stream. An embodiment of the invention is one, any or all of prior embodiments in this paragraph up through the third embodiment in this paragraph wherein the separation step separates a light stream comprising unreacted $C_4$ hydrocarbons from the first oligomerate stream. An embodiment of the invention is one, any or all of prior embodiments in this paragraph up through the third embodiment in this paragraph wherein the separation step separates an intermediate stream comprising unreacted $C_5$ hydrocarbons from the first oligomerate stream. An embodiment of the invention is one, any or all of prior embodiments in this paragraph up through the third embodiment in this paragraph wherein the separation step further comprises separating the first oligomerate stream, with the light stream separated from it, to provide the second oligomerization feed stream comprising gasoline and the heavy stream. An embodiment of the invention is one, any or all of prior embodiments in this paragraph up through the third embodiment in this paragraph wherein the heavy stream is recycled to be part of the first oligomerization feed stream. An embodiment of the invention is one, any or all of prior embodiments in this paragraph up through the third embodiment in this paragraph wherein the first catalyst is a SPA catalyst and the second catalyst is a zeolite catalyst.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for oligomerization comprising:

passing a first oligomerization feed stream comprising $C_4$ olefins to a first oligomerization reactor zone comprising a SPA first catalyst to oligomerize $C_4$ olefins in said oligomerization feed stream to produce a first oligomerate stream;

separating said first oligomerate stream from said first oligomerization reactor zone in a recovery zone to provide a second oligomerization feed stream and a heavy stream;

passing said second oligomerization feed stream to a second oligomerization reactor zone comprising a zeolite catalyst with a uni-dimensional 10-ring pore structure second catalyst different from the first catalyst to produce a second oligomerate stream comprising diesel range olefins.

2. The process of claim 1 wherein said separation step produces a gasoline stream as said second oligomerization feed stream that is oligomerized to produce said heavy stream comprising diesel.

3. The process of claim 1 wherein said separation step separates a light stream comprising unreacted $C_4$ hydrocarbons from the first oligomerate stream.

4. The process of claim 1 wherein said separation step separates an intermediate stream comprising unreacted $C_5$ hydrocarbons from the first oligomerate stream.

5. The process of claim 1 wherein said separation step separates said first oligomerate stream to provide said second oligomerization feed stream comprising gasoline and said heavy stream.

6. The process of claim 5 wherein said first oligomerate stream has the light stream separated from it before it is separated to provide said second oligomerization feed stream comprising gasoline and said heavy stream.

7. The process of claim 5 wherein said heavy stream is recycled to be part of the first oligomerization feed stream.

8. The process of claim 1 wherein said second oligomerization feed stream comprises no more than 15 wt % $C_{12}$ hydrocarbons.

9. A process for oligomerization comprising:

passing a first oligomerization feed stream comprising $C_4$ olefins to an oligomerization zone comprising SPA catalyst to oligomerize $C_4$ olefins in said oligomerization feed stream to produce a first oligomerate stream;

separating said first oligomerate stream from said oligomerization zone in a recovery zone to provide a second oligomerization feed stream and a heavy stream;

passing said second oligomerization feed stream to a second oligomerization zone comprising a zeolite catalyst comprising a uni-dimensional 10-ring pore structure to produce a second oligomerate stream comprising diesel range olefins, and wherein the zeolite catalyst is an MTT.

10. The process of claim 9 wherein said separation step produces a gasoline stream as said second oligomerization feed stream that is oligomerized to produce said heavy stream comprising diesel.

11. A process for oligomerization comprising:

passing a first oligomerization feed stream comprising $C_4$ olefins to an oligomerization zone comprising a first catalyst to oligomerize $C_4$ olefins in said oligomerization feed stream to produce a first oligomerate stream;

separating said first oligomerate stream from said oligomerization zone in a recovery zone to provide a second oligomerization feed stream and a heavy stream;

passing said second oligomerization feed stream to a second oligomerization zone comprising a second catalyst that is different from the first catalyst to produce a second oligomerate stream comprising diesel range olefins, wherein said first catalyst is a SPA catalyst and said second catalyst is a zeolite catalyst comprising a uni-dimensional 10-ring pore structure.

12. The process of claim 11 wherein said separation step separates a light stream comprising unreacted $C_4$ hydrocarbons from the first oligomerate stream.

13. The process of claim 12 wherein said separation step separates an intermediate stream comprising unreacted $C_5$ hydrocarbons from the first oligomerate stream.

14. The process of claim 12 wherein said separation step further comprises separating said first oligomerate stream, with the light stream separated from it, to provide said second oligomerization feed stream comprising gasoline and said heavy stream.

15. The process of claim 14 wherein said heavy stream is recycled to be part of the first oligomerization feed stream.

* * * * *